US012716213B2

(12) United States Patent
Donovan et al.

(10) Patent No.: US 12,716,213 B2
(45) Date of Patent: Aug. 25, 2026

(54) SYSTEMS TO MONITOR AND DETECT STATUS CHANGES OF FLUID FLOW DEVICES

(71) Applicant: STATE FARM MUTUAL AUTOMOBILE INSURANCE COMPANY, Bloomington, IL (US)

(72) Inventors: John R. Donovan, Bloomington, IL (US); Joseph Robert Brannan, Bloomington, IL (US); Aaron Williams, Congerville, IL (US); Jeffrey Wilson Stoiber, Atlanta, GA (US); Bryan R. Nussbaum, Bloomington, IL (US); Ellakate LeFebre, Mesa, AZ (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 335 days.

(21) Appl. No.: 18/459,341

(22) Filed: Aug. 31, 2023

(65) Prior Publication Data

US 2024/0183133 A1 Jun. 6, 2024

Related U.S. Application Data

(60) Provisional application No. 63/430,490, filed on Dec. 6, 2022.

(51) Int. Cl.

| | |
|---|---|
| ***E03B 7/07*** | (2006.01) |
| *E03B 7/00* | (2006.01) |
| *E03B 7/10* | (2006.01) |

(52) U.S. Cl.
CPC ..... *E03B 7/075* (2013.01); *E03B 7/071* (2013.01); *E03B 7/003* (2013.01)

(58) Field of Classification Search
CPC ..... E03B 7/075; E03B 7/071; E03B 7/003; E03B 7/10; E03F 7/00
USPC ..... 700/282
See application file for complete search history.

(56) References Cited

U.S. PATENT DOCUMENTS

| | | | | |
|---|---|---|---|---|
| 2018/0144615 | A1* | 5/2018 | Kinney | G07C 9/00571 |
| 2020/0018664 | A1* | 1/2020 | Bunker | G01M 3/26 |
| 2021/0388950 | A1* | 12/2021 | Solomon | G06Q 10/20 |

* cited by examiner

*Primary Examiner* — Michael J Brown
(74) *Attorney, Agent, or Firm* — MARSHALL, GERSTEIN & BORUN LLP

(57) ABSTRACT

Techniques are described herein for detecting status changes to fluid flow devices. An exemplary computer-implemented method may include (1) receiving, from a sensor disposed proximate to a fluid flow device, a vibration signal; (2) determining a current flow rate within the fluid flow device based upon the vibration signal; (3) detecting a status change of the fluid flow device based upon a comparison between the current flow rate and a prior flow rate; (4) determining a recommended remediation action to adjust the current flow rate to the prior flow rate; and (5) generating an alert signal indicating the status change and the recommended remediation action.

20 Claims, 6 Drawing Sheets

SYSTEMS TO MONITOR AND DETECT STATUS CHANGES OF FLUID FLOW DEVICES

CROSS-REFERENCE TO RELATED APPLICATION

This application claims priority to U.S. Provisional Patent Application No. 63/430,490, entitled "Systems to Monitor and Detect Status Changes of Fluid Flow Devices," filed on Dec. 6, 2022, the disclosure of which is hereby incorporated herein by reference.

TECHNICAL FIELD

The present disclosure generally relates to systems and methods to monitor sound and vibration proximate to fluid flow devices, and more particularly, to automatically detect status changes in fluid flow devices and generate corresponding alert signals indicating the status changes and recommended remediation actions.

BACKGROUND

Presently, the management of fluid flow devices (e.g., pipes, drains, gutters) may rely upon manual determinations of hazardous and/or otherwise problematic conditions (e.g., flooding, blocked pipe, damaged pipe), and subsequent manual methods of mitigation/remediation. For example, a property manager may notice a stain on a ceiling, and may eventually call an expert to examine the stain, determine the source, and manually mitigate/remediate the issue. This conventional fluid flow device management process may require a significant amount of time, money, and human resources. As such, individuals (e.g., homeowners, property managers) may often be limited to observing the consequences of an unmanaged fluid flow device (e.g., a ceiling mold stain, warping floorboards, etc.), and may be unable to identify potentially hazardous and/or otherwise problematic conditions during formation and/or an initial occurrence (e.g., a first drip from a leaking pipe).

Similarly, such conventional techniques may generally disable individuals from recognizing and/or otherwise mitigating/remediating hazardous and/or otherwise problematic conditions until and/or unless those conditions cause noticeable damage. To illustrate, a property owner may remain unaware of a cracked pipe leaking water into a structure foundation until the leaking pipe causes substantial damage to the foundation. As a result, the foundation may crack, and the basement may flood. The property owner may hire a contractor or other remediation services provider to repair the damage, and may only then learn about the cracked pipe. Consequently, these conventional techniques may frequently overlook or otherwise completely ignore an individual's fluid flow devices that may desperately require maintenance or repair, such that the individual's structure/devices may experience catastrophic effects (e.g., bursting pipes, major structural damage from fractured foundation, etc.) leading to exorbitantly expensive and/or irreparable damage.

Therefore, in general, conventional techniques may be insufficient for providing proper upkeep. Conventional techniques may also include additional ineffectiveness, inefficiencies, encumbrances, and/or other drawbacks.

SUMMARY

Generally, the present embodiments relate to, inter alia, systems and methods for monitoring changes to fluid flow devices (e.g., pipes, drains, gutters) via sensors (e.g., sound, vibration) to determine a recommended remediation action and generate an alert signal indicating a status change and the recommended remediation action. In this manner, the systems and methods of the present disclosure may enable individuals to rapidly intervene and remediate potentially hazardous and/or otherwise problematic conditions (e.g., flooding, blocked pipe) arising from status changes in fluid flow devices.

In particular, the techniques of the present disclosure may consider factors related to monitoring status changes of fluid flow devices such as sensor data, user profile data, environmental data, remediation action data, verification data, among other factors. Additionally, the techniques of the present disclosure may consider factors related to each fluid flow device, such as position in a structure, age, function, historical fluid flow and flow rates, sensor type in use, among other factors. Moreover, the techniques of the present disclosure may incorporate rules-based algorithms that monitor changes in fluid flow devices and actively intervene to adjust fluid flow rates. The techniques may accordingly determine the presence of a status change the moment it first occurs and minimize the amount of time between occurrence and remediation.

One exemplary embodiment of the present disclosure may be a computer-implemented method for detecting status changes to fluid flow devices. The computer-implemented method may be implemented via one or more local or remote processors, servers, sensors, transceivers, memory units, mobile devices, wearables, smart glasses, smart watches, augmented reality glasses, virtual reality headset, mixed or extended reality glasses or headsets, smart contacts, and/or other electronic or electrical components, which may be in wired or wireless communication with one another. In one instance, the method may include: (1) receiving, from a sensor disposed proximate to a fluid flow device, a vibration signal; (2) determining, by one or more processors, a current flow rate within the fluid flow device based upon the vibration signal; (3) detecting, by the one or more processors, a status change of the fluid flow device based upon a comparison between the current flow rate and a prior flow rate; (4) determining, by the one or more processors, a recommended remediation action to adjust the current flow rate to the prior flow rate; and/or (5) generating, by the one or more processors, an alert signal indicating the status change and the recommended remediation action. The method may include additional, less, or alternate actions, including those discussed elsewhere herein.

For instance, in a variation of this embodiment, detecting the status change of the fluid flow device may further include: (i) determining, by the one or more processors, a difference value by subtracting the current flow rate from the prior flow rate; (ii) comparing, by the one or more processors, an absolute value of the difference value to a flow rate threshold corresponding to the fluid flow device; and/or (iii) detecting, by the one or more processors, the status change of the fluid flow device based upon an absolute value of the difference value exceeding the flow rate threshold.

In another variation of this embodiment, the fluid flow device may be disposed within a structure having a water supply valve. The computer-implemented method may further include: (i) determining, by the one or more processors, the status change is representative of an emergency condition and/or (ii) causing, by the one or more processors, the water supply valve to close.

In yet another variation of this embodiment, the fluid flow device may be a gutter disposed on a structure exterior. The computer-implemented method may further include: (i) determining, by the one or more processors, that the gutter is unable to distribute water a threshold distance away from the structure exterior; (ii) determining, by the one or more processors, an estimated location of a blockage of the gutter based upon the vibration signal; and/or (iii) wherein the recommended remediation action includes the estimated location of the blockage.

In still another variation of this embodiment, the computer-implemented method may further include: (i) receiving, at the one or more processors, external environment data representative of an external environmental condition; and/or (ii) determining, by the one or more processors, the status change of the fluid flow device based upon a second comparison between the current flow rate, the external environment data, and the prior flow rate.

In an additional variation of this embodiment, the sensor may be a vibrational sensor disposed proximate to the fluid flow device. The computer-implemented method may further include: (i) receiving from a sound sensor, a sound signal; (ii) determining, by the one or more processors, a second current flow rate within the fluid flow device based upon the sound signal; and/or (iii) detecting, by the one or more processors, the status change of the fluid flow device based upon a second comparison between the current flow rate, the second current flow rate, and the prior flow rate.

In yet an additional variation of this embodiment, the fluid flow device may be either a sink or a toilet disposed within a structure. The computer-implemented method may further include: (i) aggregating, by the one or more processors, vibration signals corresponding to the fluid flow device during a time period; and/or (ii) determining, by the one or more processors, an estimated occupancy of the structure based upon the vibration signals aggregated during the time period.

In still an additional variation of this embodiment the recommended remediation action may include at least one of (i) patching a portion of the fluid flow device, (ii) unblocking a portion of the fluid flow device, and/or (iii) adjusting a configuration of the fluid flow device.

In another variation of this embodiment, the method may further include: (i) receiving, from a user computing device, a verification signal; (ii) generating, by the one or more processors, recommended information for a remediation service; and/or (iii) initiating, by the one or more processors, contact between the user computing device and the remediation service computing device.

Another exemplary embodiment of the present disclosure is a computer system for detecting status changes to fluid flow devices. The computer system may be implemented via one or more local or remote processors, servers, sensors, transceivers, memory units, mobile devices, wearables, smart glasses, smart watches, augmented reality glasses, virtual reality headset, mixed or extended reality glasses or headsets, smart contacts, and/or other electronic or electrical components, which may be in wired or wireless communication with one another. In one instance, the system may include: (1) one or more processors and (2) a non-transitory computer-readable memory coupled to the one or more processors. The memory may store instructions thereon that, when executed by the one or more processors, may cause the one or more processors to: (i) receive, from a sensor disposed proximate to a fluid flow device, a vibration signal, (ii) determine a current flow rate within the fluid flow device based upon the vibration signal, (iii) detect a status change of the fluid flow device based upon a comparison between the current flow rate and a prior flow rate, (iv) determine a recommended remediation action to adjust the current flow rate to the prior flow rate, and/or (v) generate an alert signal indicating the status change and the recommended remediation action. The computer system may be configured with additional, less, or alternate functionality, including that discussed elsewhere herein.

For instance, in a variation of this embodiment, the instructions, when executed by the one or more processors, may further cause the one or more processors to: detect the status change of the fluid flow device by (i) determining a difference value by subtracting the current flow rate from the prior flow rate; (ii) comparing an absolute value of the difference value to a flow rate threshold corresponding to the fluid flow device; and/or (iii) detecting the status change of the fluid flow device based upon the absolute value of the difference value exceeding the flow rate threshold.

In another variation of this embodiment the fluid flow device may be disposed within a structure having a water supply valve. The instructions, when executed by the one or more processors, may further cause the one or more processors to: (i) determine that the status change is representative of an emergency condition; and/or (ii) cause the water supply valve to close.

In yet another variation of this embodiment, the fluid flow device may be a gutter disposed on a structure exterior. The instructions, when executed by the one or more processors, may further cause the one or more processors to: (i) determine that the gutter is unable to distribute water a threshold distance away from the structure exterior; (ii) determine an estimated location of a blockage of the gutter based upon the vibration signal; and/or (iii) wherein the recommended remediation action includes the estimated location of the blockage.

In still another variation of this embodiment the instructions, when executed by the one or more processors, may further cause the one or more processors to: (i) receive external environment data representative of an external environmental condition; and/or (ii) determine the status change of the fluid flow device based upon a second comparison between the current flow rate, the external environment data, and the prior flow rate.

In an additional variation of this embodiment, the sensor may be a vibration sensor disposed proximate to the fluid flow device. The instructions, when executed by the one or more processors, may further cause the one or more processors to: (i) receive, from a sound sensor, a sound signal; (ii) determine a second current flow rate within the fluid flow device based upon the sound signal; and/or (iii) detect the status change of the fluid flow device based upon a second comparison between the current flow rate, the second current flow rate, and the prior flow rate.

Another exemplary embodiment of the present disclosure may be a tangible machine-readable medium which may include instructions for detecting status changes to fluid flow devices. The instructions of the tangible machine-readable medium thereon may be implemented via one or more local or remote processors, servers, sensors, transceivers, memory units, mobile devices, wearables, smart glasses, smart watches, augmented reality glasses, virtual reality headset, mixed or extended reality glasses or headsets, smart contacts, and/or other electronic or electrical components, which may be in wired or wireless communication with one another. In one instance, the instructions of the tangible machine-readable medium, when executed, may cause a machine to at least: (1) receive, from a sensor disposed proximate to a fluid flow device, a vibration signal; (2) determine a current flow rate within the fluid flow device based upon the vibration signal; (3) detect a status change of the fluid flow device based upon a comparison between the current flow rate and a prior flow rate; (4) determine a recommended remediation action to adjust the current flow rate to the prior flow rate; and/or (5) generate an alert signal indicating the status change and the recommended remediation action. The instructions may direct additional, less, or alternate functionality, including that discussed elsewhere herein.

For instance, in a variation of this embodiment, the instructions, when executed, may further cause the machine to at least: (i) detect the status change of the fluid flow device by determining a difference value by subtracting the current flow rate from the prior flow rate; (ii) comparing an absolute value of the difference value to a flow rate threshold corresponding to the fluid flow device; and/or/ (iii) detecting the status change of the fluid flow device based upon the absolute value of the difference value exceeding the flow rate threshold.

In another variation of this embodiment, the fluid flow device may be disposed within a structure having a water supply valve. The instructions, when executed, may further cause the machine to at least: (i) determine that the status change is representative of an emergency condition, and/or (ii) cause the water supply valve to close.

In yet another variation of this embodiment, the fluid flow device may be a gutter disposed on a structure exterior. The instructions, when executed, may further cause the machine to at least: (i) determine that the gutter is unable to distribute water a threshold distance away from the structure exterior; (ii) determine an estimated location of a blockage of the gutter based upon the vibration signal; and/or (iii) include the estimated location of the blockage in the recommended remediation action.

In still another variation of this embodiment, the sensor may be a vibration sensor disposed proximate to the fluid flow device. The instructions, when executed, may further cause the machine to at least: (i) receive, from a sound sensor, a sound signal; (ii) determine a second current flow rate within the fluid flow device based upon the sound signal; and/or (iii) detect the status change of the fluid flow device based upon a second comparison between the current flow rate, the second current flow rate, and the prior flow rate.

In accordance with the above, and with the disclosure herein, the present disclosure includes improvements in computer functionality or in improvements to other technologies at least because the present disclosure describes that, e.g., fluid flow devices and other various components, may be improved or enhanced with the disclosed systems and methods that provide status change detection and remediation recommendations for such fluid flow devices. That is, the present disclosure describes improvements in the functioning of a computer itself or "any other technology or technical field" (e.g., home improvement/maintenance) because the disclosed systems and methods provide (1) real-time determinations of fluid flow devices experiencing a status change (e.g., reduced/increased fluid flow rate) and (2) remediation recommendations to resolve such status changes in a manner that is unachievable using conventional systems and methods. This improves over the prior art at least because such conventional techniques lack the ability for constant, instantaneous status change detection and remediation recommendation of conventionally inaccessible fluid flow devices.

Moreover, the present disclosure includes effecting a transformation or reduction of a particular article to a different state or thing, e.g., transforming or reducing the status change detection, remediation, and general upkeep of fluid flow devices from a non-optimal or error state to an optimal state.

Still further, the present disclosure includes specific features other than what is well-understood, routine, conventional activity in the field, or adding unconventional steps that demonstrate, in various embodiments, particular useful applications, e.g., receiving, from a sensor disposed proximate to a fluid flow device, a vibration signal; determining, by one or more processors, a current flow rate within the fluid flow device based upon the vibration signal; detecting, by the one or more processors, a status change of the fluid flow device based upon a comparison between the current flow rate and a prior flow rate; and/or determining, by the one or more processors, a recommended remediation action to adjust the current flow rate to the prior flow rate.

BRIEF DESCRIPTION OF THE DRAWINGS

The Figures described below depict various aspects of the system and methods disclosed therein. It should be understood that each Figure depicts an embodiment of a particular aspect of the disclosed system and methods, and that each of the Figures is intended to accord with a possible embodiment thereof. Further, wherever possible, the following description refers to the reference numerals included in the following Figures, in which features depicted in multiple Figures are designated with consistent reference numerals.

There are shown in the drawings arrangements which are presently discussed, it being understood, however, that the present embodiments are not limited to the precise arrangements and instrumentalities shown, wherein.

The Figures depict preferred embodiments for purposes of illustration only. One skilled in the art will readily recognize from the following discussion that alternative embodiments of the systems and methods illustrated herein may be employed without departing from the principles of the invention described herein.

DETAILED DESCRIPTION

Techniques, systems, apparatuses, components, devices, and methods are disclosed for, inter alia, monitoring and detecting status changes to fluid flow devices. Namely, the present techniques monitor fluid flow devices via proximate sensors sending signals to a system to determine fluid flow rates, detect a change in the fluid flow rates, determine appropriate remediation actions to adjust fluid flow rates, and generate an alert signal indicating the change in fluid flow rates and the determined remediation action. The techniques of the present disclosure may consider factors related to monitoring fluid flow devices such as sensor data, user profile data, environmental data, remediation action data, verification data, among other factors. Additionally, the techniques of the present disclosure may consider factors related to each fluid flow device, such as position in a structure, age, function, historical fluid flow and flow rates, sensor type in use, among other factors. Moreover, the techniques of the present disclosure may incorporate rules-based algorithms that monitor changes in fluid flow and actively intervene to adjust fluid flow rates. The techniques of the present disclosure may accordingly determine the presence of a status change the moment it first occurs and minimize the amount of time between occurrence and remediation.

Exemplary Computing System to Detect Status Changes to Fluid Flow Devices

Figure 1:
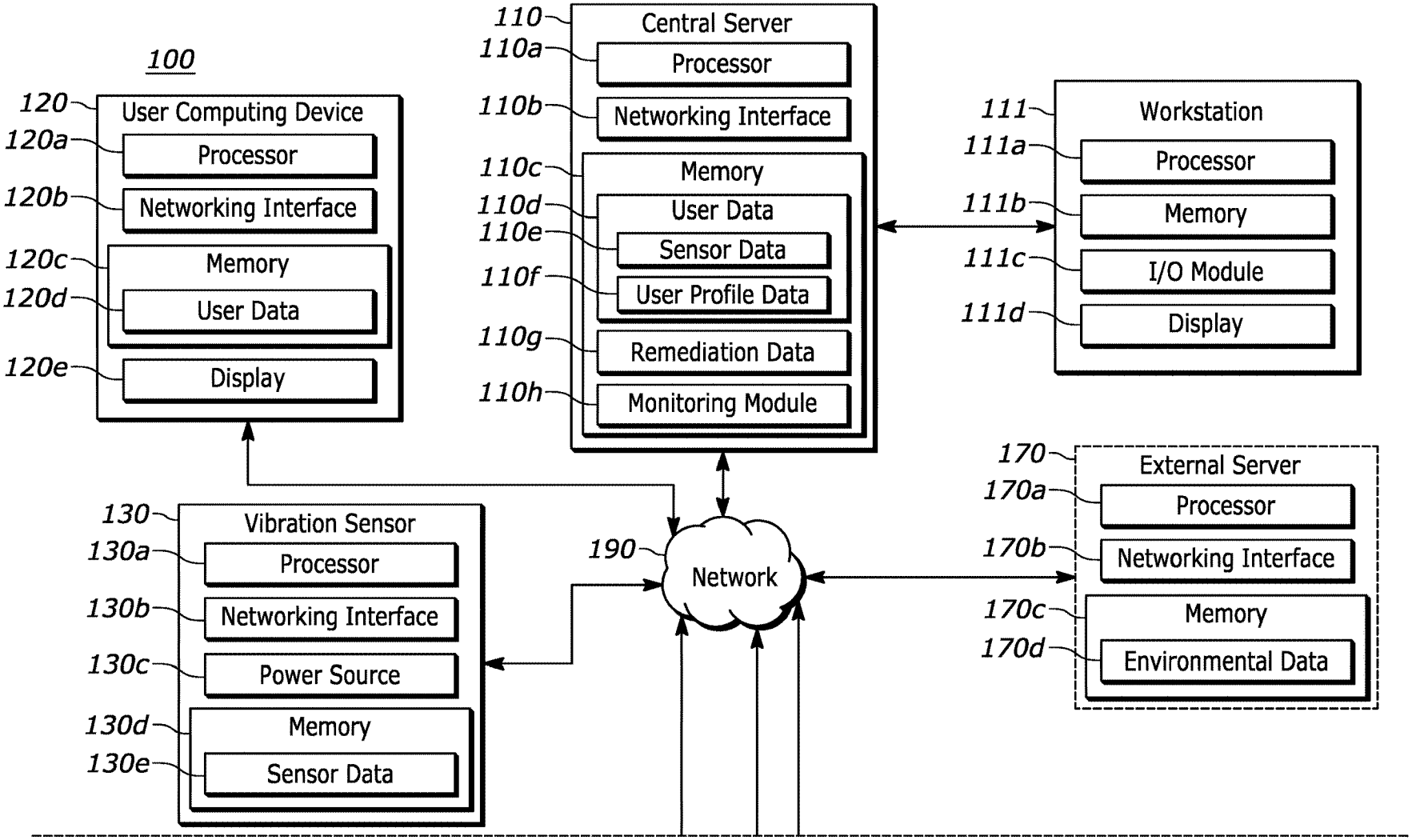
FIG. 1 depicts an exemplary computing system for detecting status changes to fluid flow devices, in accordance with various embodiments described herein.
Figure 1:
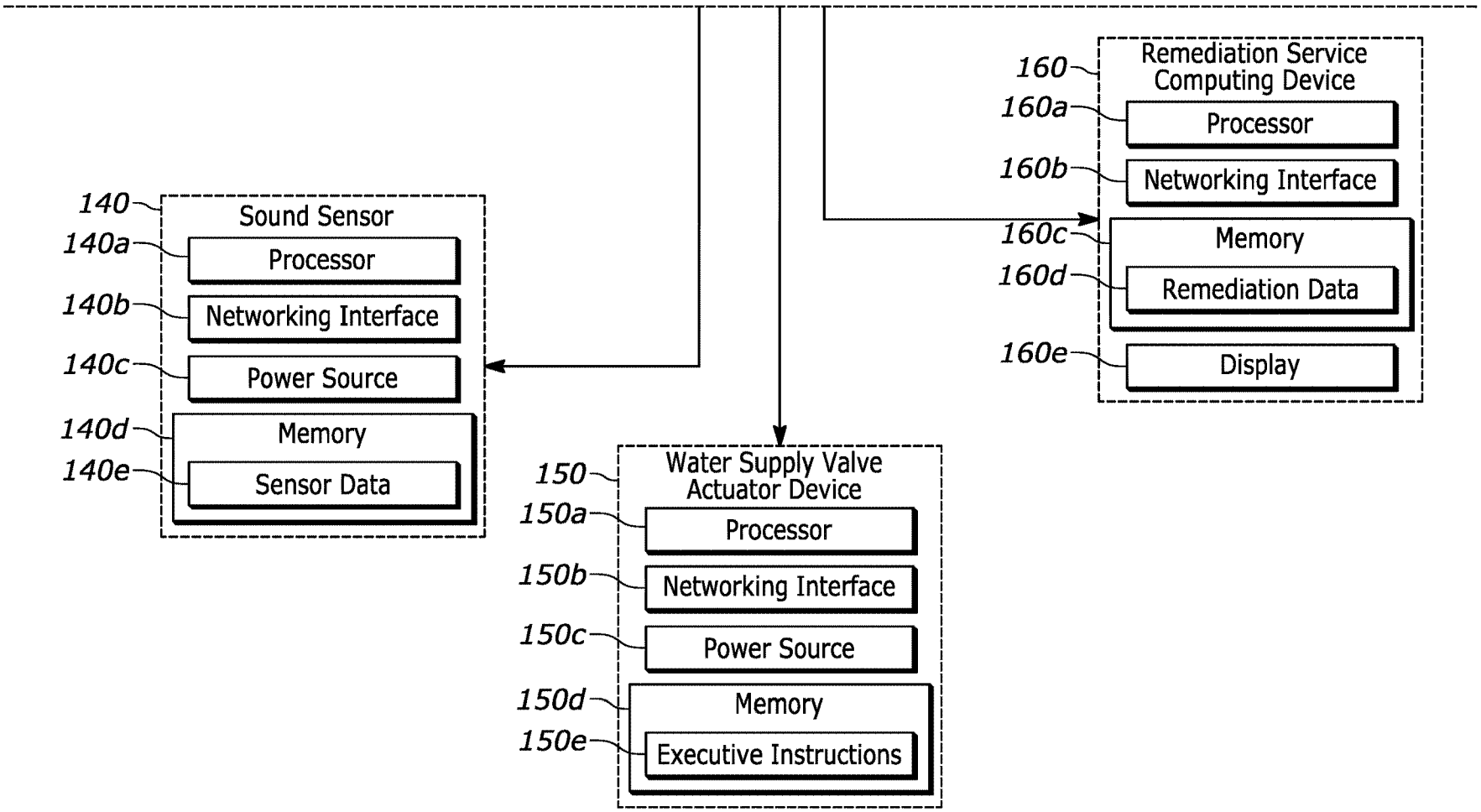

FIG. 1 depicts an exemplary computing system 100 to detect status changes to fluid flow devices, in accordance with various embodiments described herein. Generally, the system 100 may determine a current flow rate within the fluid flow devices (e.g., pipes, gutters, drains), detect a status change of the fluid flow devices, determine a recommended remediation action to adjust the current flow rate to the prior flow rate, and generate an alert signal indicating the status change and the recommended remediation action. Depending on the embodiment, the system 100 may source data from a plurality of sensors (e.g., 130, 140), a central server (e.g., 110), external servers (e.g., 170), computing devices (e.g., 120, 160), workstations (e.g., 111), actuating devices (e.g., 150), or any combinations thereof, to be utilized in any step of the monitoring of fluid flow devices. Monitoring, as discussed herein, may be broadly understood as an active and/or passive process, including constantly and/or frequently sensing ambient vibrations, sounds, and/or any other suitable observable proximate to fluid flow devices and utilizing the sensed observables to generate an alert signal. Accordingly, the system 100 may constantly and/or frequently monitor such observables corresponding to any fluid flow devices described herein.

In some embodiments, the sensors (e.g., 130, 140) may initiate monitoring by being proximate to the fluid flow devices. In these embodiments, a network 190 may receive a vibration signal from a vibration sensor 130. The vibration sensor 130 may include instruments (not shown) capable of translating proximate mechanical vibrations into a computer-readable signal (e.g., analog, digital). In particular, the vibration sensor may also include a processor 130*a*, a networking interface 130*b*, a power source 130*c*, and a non-transitory computer-readable memory 130*d* coupled to the processor(s) 130*a*. The memory 130*d* may include sensor data 130*e*, which also may include identifying information (e.g., sensor identification number, relative position to other sensors, the user's profile identification number, etc.), the sensor signal, time-stamp data for the signal, and/or any other suitable data or combinations thereof.

In some embodiments, the network 190 may receive a sound signal from a sound sensor 140. The sound sensor 140 may include instruments (not shown) capable of translating sound into a computer-readable signal. The sound sensor may also include a processor 140*a*, a networking interface 140*b*, a power source 140*c*, and a non-transitory computer-readable memory 140*d* coupled to the processor(s) 140*a*. The memory 140*d* may include sensor data 140*e*, which may also include identifying information (e.g., sensor identification number, relative position to other sensors, the user's profile identification number, etc.), the sensor signal, time-stamp data for the signal, and/or any other suitable data or combinations thereof.

Signals generated and/or transmitted from the sensors 130, 140 may be transmitted through the network 190 to a central server 110 for processing/analysis. Generally, the central server 110 may utilize the computer-readable signal(s) from the sensors 130, 140 to determine a current flow rate within the proximate fluid flow device, detect a status change of the fluid flow device based upon a comparison between the current flow rate and the prior low rate, determine a recommended remediation action to adjust the current flow rate to the prior flow rate, and/or generate an alert signal indicating the status change and the recommended remediation action. Furthermore, in certain embodiments, the central server 110 and/or other component(s) of the exemplary computing system 100 may utilize/analyze signals from the vibration sensor 130, the sound sensor 140, and/or any other sensor(s) connected to the network 190 individually, in sequence (i.e., one and then the other), or concurrently (i.e., at the same time). In this manner, the central server 110 may determine a current flow rate and a second current flow rate to detect a status change of the fluid flow device based upon comparison(s) with the current and second current flow rates and/or with a prior flow rate.

Figure 2:
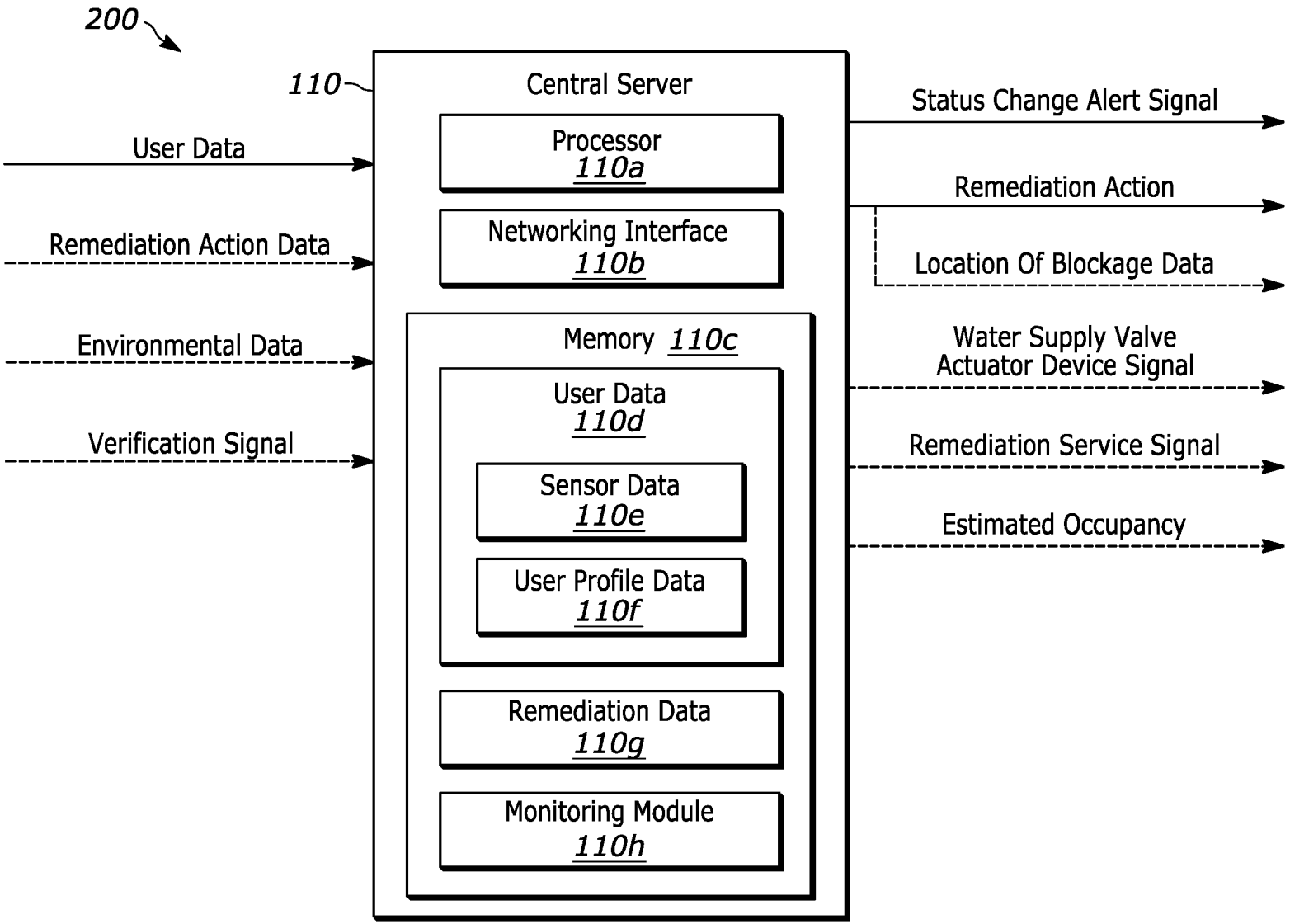
FIG. 2 depicts an exemplary workflow for a computing device of FIG. 1, in accordance with various embodiments described herein.

Accordingly, the central server 110 may continue the monitoring of fluid flow devices by receiving the sensor signals from the sensors 130, 140 Generally speaking, the central server 110 may include a processor 110*a*, a networking interface 110*b*, and a non-transitory computer readable memory 110*c* coupled to the processor(s) 140*a*. The memory 110*c* may store data and/or instructions executable by the processor(s) 110*a*. As illustrated in FIG. 1 and FIG. 2, the data stored on the memory 110*c* may be differentiated as user data 110*d*, remediation data 110*g*, or as belonging to a monitoring module 110*h*. The user data 110*d* may include the sensor data 110*e*, including all information relevant/associated to sensor function, and/or user profile data 110*f*, including all information relevant/associated to the user's profile (e.g., user account identification number, location of user and/or structure, estimated and/or actual occupancy of the structure, etc.).

Information may also be stored as user data 110*d* without differentiating it as sensor data 110*e* or user profile data 110*f*. Remediation data 110*g* may include remediation actions, executable functions to determine a recommended remediation action, and/or all information relevant/associated with recommended remediation actions (e.g., estimated location of blockage). The monitoring module 110*h* may include computing instructions that are executable by the processor 110*a* and allow for monitoring fluid flow devices. The monitoring module 110*h* may also include a plurality of models trained to compute outputs to be utilized by the system 100. Models and exemplary embodiments are discussed in further detail in FIG. 2. However, it should be understood that the monitoring module 110*h* may include any suitable set of instructions for monitoring fluid flow devices, such as a machine learning (ML) model configured to receive inputs from the system 100 and output data utilized by the system 100.

More specifically, in some embodiments, the monitoring module 110*h* may utilize one or more machine learning (ML) techniques to train the plurality of models therein as ML model(s). A machine learning (ML) model may be configured to receive user data, environmental data, remediation action data, and/or verification signal data and output current flow rate(s), status change alert signal(s), recommended remediation action(s), location of blockage data, water supply valve actuator device signal(s), remediation service signal(s), and/or the estimated occupancy of a structure. In these aspects, the system 100 may further include training, by one or more processors, the ML model using (i) a plurality of training user data, (ii) a plurality of training sensor data, (iii) a plurality of training environmental data, (iv) a plurality of training verification signal data, (v) a plurality of training recommended remediation data, (vi) a plurality of training location blockage data, (vii) a plurality of training water supply valve actuator device data, (viii) a plurality of training remediation service provider data, and/or (ix) a plurality of training estimated occupancy data. Further in these embodiments, the monitoring module 110*h*, when described herein as determining/detecting/generating outputs for endogenous and/or exogenous use, the module 110*h* may be applying, by the one or more processors, a ML model.

Generally speaking, ML (Machine Learning) techniques have been developed that allow parametric or nonparametric statistical analysis of large quantities of data. Such ML techniques may be used to automatically identify relevant variables (i.e., variables having statistical significance or a sufficient degree of explanatory power) from data sets. This may include identifying relevant variables or estimating the effect of such variables that indicate actual observations in the data set. This may also include identifying latent variables not directly observed in the data, viz. variables inferred from the observed data points. More specifically, a processor or a processing element may be trained using supervised or unsupervised ML.

In supervised machine learning, a machine learning program operating on a server, computing device, or otherwise processors, may be provided with example inputs (e.g., "features") and their associated, or observed, outputs (e.g., "labels") in order for the machine learning program or algorithm to determine or discover rules, relationships, patterns, or otherwise machine learning "models" that map such inputs (e.g., "features") to the outputs (e.g., labels), for example, by determining and/or assigning weights or other metrics to the model across its various feature categories. Such rules, relationships, or otherwise models may then be provided subsequent inputs in order for the model, executing on a server, computing device, or otherwise processors as described herein, to predict or classify, based upon the discovered rules, relationships, or model, an expected output, score, or value.

In unsupervised machine learning, the server, computing device, or otherwise processors, may be required to find its own structure in unlabeled example inputs, where, for example multiple training iterations are executed by the server, computing device, or otherwise processors to train multiple generations of models until a satisfactory model, e.g., a model that provides sufficient accuracy when given test level or production level data or inputs, is generated.

Exemplary ML programs/algorithms that may be utilized by the monitoring module 110*h* to train the plurality of models and/or by the models include, without limitation: neural networks (NN) (e.g., convolutional neural networks (CNN), deep learning neural networks (DNN), combined learning module or program), linear regression, logistic regression, decision trees, support vector machines (SVM), naïve Bayes algorithms, k-nearest neighbor (KNN) algorithms, random forest algorithms, gradient boosting algorithms, Bayesian program learning (BPL), voice recognition and synthesis algorithms, image or object recognition, optical character recognition (OCR), natural language understanding (NLU), and/or other ML programs/algorithms either individually or in combination.

After training, ML programs (or information generated by such ML programs) may be used to evaluate additional data. Such data may be and/or may be related to sensor data of user data (e.g., fluid flow device specific current flow rate history for a particular user) that was not included in the training dataset. The trained ML programs (or programs utilizing models, parameters, or other data produced through the training process) may accordingly be used for determining, assessing, analyzing, predicting, estimating, evaluating, or otherwise processing new data not included in the training dataset. Such trained ML programs may, therefore, be used to perform part or all of the analytical functions of the methods described elsewhere herein.

It is to be understood that supervised ML and/or unsupervised ML may also comprise retraining, relearning, or otherwise updating models with new, or different, information, which may include information received, ingested, generated, or otherwise used over time. The disclosures herein may use one or more of such supervised and/or unsupervised ML techniques. Further, it should be appreciated that, as previously mentioned, the monitoring module 110*h* may be used to output current flow rate(s), status change alert signal(s), recommended remediation action(s), location of blockage data, water supply valve actuator device signal(s), remediation service signal(s), and/or the estimated occupancy of a structure, using artificial intelligence (e.g., a ML model of the model included in the monitoring module 110*h*) or, in alternative aspects, without using artificial intelligence.

Moreover, although the methods described elsewhere herein may not directly mention ML techniques, such methods may be read to include such ML for any determination or processing of data that may be accomplished using such techniques. In some aspects, such ML techniques may be implemented automatically upon occurrence of certain events or upon certain conditions being met. In any event, use of ML techniques, as described herein, may begin with training a ML program, or such techniques may begin with a previously trained ML program.

In certain embodiments, the central server 110 may receive/retrieve input from a workstation 111. As previously noted, the workstation 111 allows direct access to the central server 110. The workstation 111 may have an input/output (I/O) module 111*c* that has capabilities for direct input of data (e.g., user data, remediation action data, environmental data, verification signal data) and direct extraction of data, which may include outputs of the central server 110 and/or removal of data stored on the central server or in the system 100. Furthermore, the workstation may allow for configuration and/or reconfiguration of processors 110*a*, 111*a*, 120*a*, 130*a*, 140*a*, 150*a*, 160*a*, 170*a*, network interfaces 110*b*, 120*b*, 130*b*, 140*b*, 150*b*, 160*b*, 170*b*, memories, 110*c*, 1/1*b*, 120*c*, 130*d*, 140*d*, 150*d*, 160*c*, 170*c*, displays 111*d*, 120*e*, 160*e*, power sources 130*c*, 140*c*, 150*c*, executive instructions 150*e*, and/or the monitoring module 110*h*. It should be understood that the workstation 111 may access the network 190.

In some embodiments the central server 110 may further determine a status change by determining, by the one or more processors 110*a*, a difference value by subtracting the current flow rate from the prior flow rate. The central server 110 may then compare, by the one or more processors 110*a*, an absolute value of the difference value to a flow rate threshold corresponding to the fluid flow device. The central server 110 may then detect, by the one or more processors

110*a*, the status change of the fluid flow device based upon the absolute value of the difference value exceeding/not exceeding the flow rate threshold. For example, the current flow rate of fluid in a fluid flow device may be 6 gallons per minute (GPM) while the prior flow rate may be 2 GPM. The absolute value of the difference of the prior flow rate and the current flow rate is equal to 4 GPM, represented formulaically as |2 GPM−6 GPM|=4 GPM. The central server 110 may then compare this value to a threshold. In this instance, a change in flow rate of 3 GPM may be defined as the threshold value in the central server 110. The central server 110 may then compare the difference value, 4 GPM, to the threshold value, 3 GPM, and may detect a status change as 4 GPM exceeds 3 GPM.

Figure 4:
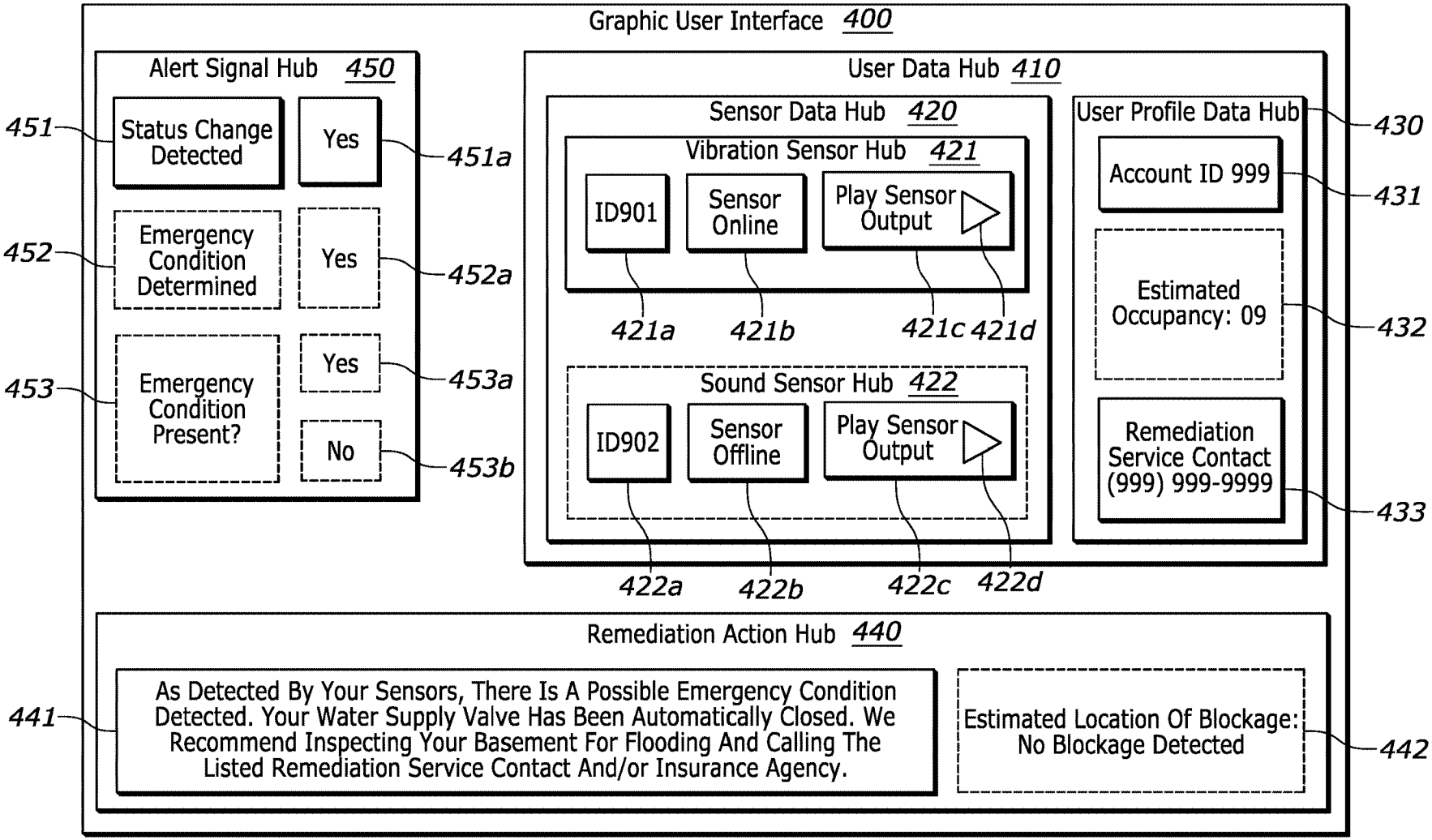
FIG. 4 depicts a graphical user interface (GUI) of a user computing device of FIG. 1 used to display, for example, user data, remediation action data, and alert signal data, in accordance with various embodiments described herein.

In any event, alert signals generated by the central server 110 may be transmitted to any suitable device connected to the network 190. For example, the alert signal generated by the central server 110 may be sent through the network 190 to a user computing device 120. As a consequence, the user computing device 120 may enable the user to monitor fluid flow devices by allowing the user to interact with the system 100, particularly in response to receiving an alert signal from the central server 110. Upon receiving the alert signal, the user computing device 120 may render the information contained and/or otherwise indicated therein (e.g., status change, a recommended remediation action) on the display 120*e* for the user to interpret. FIG. 4 depicts an exemplary graphical user interface (GUI) that may be rendered for display (e.g., via display 120*e*) to a user, and that may enable the user to interact with the data rendered therein. Generally, the user computing device 120 may include a processor 120*a*, a networking interface 120*b*, a non-transitory computer readable memory 120*c*, and a display 120*e*. The memory 120*c* may include user data 120*d* identical to or different from the user data 110*d* stored on the memory 110*c* of the central server 110.

In some embodiments, the central server 110 may receive a verification signal from the user computing device 120, generate recommended information for a remediation service, and initiate contact between the user computing device 120 and a remediation service computing device 160. Accordingly, these embodiments may further expedite remediation actions as a result of the central server 110 determining that a status change of a particular/multiple fluid flow device(s) is representative of an emergency. For example, a user's toilet may be clogged and the central server 110 may generate an alert signal. The user may receive the alert signal indicating a clogged toilet. The user may witness a toilet overflowing with wastewater, and may validate the alert signal, such that the central server 110 receives a verification signal. The user may then be connected with a remediation service (e.g., information hotline, plumbing directory) to remediate the issue. In particular, the remediation computing device 160 may include a processor 160*a*, a networking interface 160*b*, a non-transitory computer readable memory 160*c*, and a display 160*e*. The memory 160*c* may include remediation data 160*d* identical to or different from the remediation data 110*g* stored on the memory 110*c* of the central server 110.

In certain embodiments, wherein the fluid flow device is disposed within a structure having a water supply valve, the central server 110 may determine the status change to be representative of an emergency condition (e.g., burst pipe, flooding) and cause the water supply valve to close via a water supply valve actuator device 150. Therefore, in these embodiments, the central server 110 may take immediate remediation action by transmitting a signal that mitigates the emergency condition by shutting off water supply to the structure, and thereby avoiding further damage from the burst pipe. The water supply valve actuator device 150 may include instruments (not shown) capable of closing/opening a water supply valve, and more particularly may include a processor 150*a*, a networking interface 150*b*, a power source 150*c*, and a non-transitory computer readable memory 150*d*. The memory 150*d* may include stored executive instructions 150*e* that, when executed, cause the water supply valve to close/open.

In some embodiments, the fluid flow device may be a gutter disposed on a structure exterior. In these embodiments, the central server 110 may determine that the gutter is unable to distribute water a threshold distance away from the structure exterior, may determine an estimated location of a blockage of the gutter based upon the vibration signal received from the vibration sensor 130, and/or may include the estimated location of the blockage in the recommended remediation action. For example, a section of a gutter pipe may have detached from the rest of the gutter pipe system, thereby causing water to be poured next to the structure instead of into a storm drain. The central server 110 may detect this status change and also determine the estimated location of the blockage preventing the flow of water away from the structure based upon the vibration signal. A user may then receive an alert signal from the central server 110 via the user computing device 120 that indicates the location of the blockage, observe the detached gutter pipe, and remediate the issue.

In certain embodiments, the fluid flow device may be a sink or a toilet disposed within a structure, and the central server 110 may aggregate vibration signals corresponding to the fluid flow device during a time period. The central server 110 may then determine an estimated occupancy of the structure based upon the vibration signals aggregated during the time period. For example, a user may want to know the estimated occupancy of their property compared to the actual occupancy of their property to determine if they over consume water resources. The central server 110 may aggregate signals from sensors (e.g., 130, 140) which correspond to a single toilet on the user's property, and the central server 110 may then determine an estimated occupancy and cause the estimated occupancy to be rendered on the display 120*e* of the user computing device 120. In this way, the user may determine and/or the central server 110 may recommend as part of the estimated occupancy how to adjust usage of the toilet and/or other water-consuming resources to reduce the user's water consumption.

In some embodiments, the system 100 may include an external server 170. The external server 170, in particular, may include a processor 170*a*, a networking interface 170*b*, and a non-transitory computer-readable memory 170*c*. The memory 170*c* may further include stored environmental data 170*d* (e.g., temperature, precipitation, or radar data). The central server 110 may receive the external environment data 170 representative of an external environmental condition and determine the status change of the fluid flow device based upon a second comparison between a current flow rate, the external environment data, and a prior flow rate. In certain embodiments, the system 100 may further include a plurality of external servers (e.g., represented collectively as external server 170) to assist in the monitoring of fluid flow devices.

Each of the processors 110*a*, 111*a*, 120*a*, 130*a*, 140*a*, 150*a*, 160*a*, 170*a*, may include any suitable number of processors and/or processor types. For example, the processors 110*a*, 111*a*, 120*a*, 130*a*, 140*a*, 150*a*, 160*a*, 170*a*, may include one or more CPUs and one or more graphics processing units (GPUs). Generally, each of the processors 110*a*, 111*a*, 120*a*, 130*a*, 140*a*, 150*a*, 160*a*, 170*a* may be configured to execute software instructions stored in each of the corresponding memories 110*c*, 111*b*, 120*c*, 130*d*, 140*d*, 150*d*, 160*c*, 170*c*. The memories 110*b*, 111*b*, 120*b*, 130*b*, 140*b*, 150*b*, 160*b*, 170*b* may include one or more persistent memories (e.g., a hard drive and/or solid-state memory) and may store one or more applications and/or modules, such as the monitoring module 110*h*.

Each of the central server 110, the user computing device 120, the vibration sensor 130, the sound sensor 140, the water supply valve actuator device 150, the remediation service computing device 160, and the external server 170 may be communicatively coupled together via the network 190 and the respective networking interfaces 110*b*, 120*b*, 130*b*, 140*b*, 150*b*, 160*b*, 170*b*. The network 190 may be a single communication network or may include multiple communication networks of one or more types (e.g., one or more wired and/or wireless local area networks (LANs), and/or one or more wired and/or wireless wide area networks (WANs), such as the internet).

The illustration of the power sources 130*c*, 140*c*, 150*c* does not limit the use of power sources in the system 100. Each of the central server 110, the workstation 111, the user computing device 120 the remediation service computing device 160, and the external server 170 may include a power source.

Exemplary Workflow for a Computing Device to Detect Status Changes to Fluid Flow Devices FIG. 2 depicts an exemplary workflow 200 for a computing device (e.g., the central server 110), in accordance with various embodiments described herein. The exemplary workflow 200 generally illustrates various data received/retrieved by the central server 110 that is utilized by the monitoring module 110*h* as inputs to generate various outputs. The various data received/retrieved by the central server 110 includes user data, remediation action data, environmental data, and/or verification signal(s). The various outputs generated by the monitoring module 110*h* based upon the received/retrieved data includes status change alert signal(s), recommended remediation action(s), which may include location of blockage data, water supply valve actuator device signal(s), remediation service signal(s), and/or estimated occupancy signal(s).

As previously described, the user data, remediation action data, environmental data, and/or verification signal(s) received/retrieved by the central server 110 may include a large variety of specific information/data. For example, the user data may include the sensor data, including all information relevant/associated to sensor function (e.g., sensor identification number, relative position to other sensors, the sensor signal, time-stamp data for the signal), and user profile data, including all information relevant/associated to the user's profile (e.g., user account identification number, location of user and/or structure, estimated and/or actual occupancy of the structure, etc.). As illustrated, the memory 110*c* of the central server 110 may store received/retrieved user data as user data 110*d*, which may store sensor data 110*e* and/or user profile data 110*f*.

The received/retrieved remediation action data may include all information relevant/associated to remediation action. For example, a catalog of remediation actions, values to determine when a remediation action is recommended over another, a catalog of remediation protocols, and/or a catalog of remediation/emergency services. As illustrated, the memory 110*c* of the central server 110 may store the received/retrieved remediation action data as remediation action data 110*g*.

The received/retrieved environmental data may include all information relevant/associated to environmental conditions and may be stored generally in memory 110*c* or specifically in designated data stores. Environmental data may include, for example, precipitation data, temperature data, radar data, and/or forecasted weather. Received/retrieved environmental data may be stored on the memory 110*c* of the central server 110, as well as the memory 170*c* of the external server 170 as illustrated in FIG. 1.

The received/retrieved verification signal may include all information relevant/associated to verifying a status change. For example, a user indicating a status change, user indicating no status change, and/or a user indicating need for remediation/emergency services. The memory 110*c* of the central server 110 may store the received/retrieved verification signal, as well as the memory of an external server, or the memory 160*c* of the remediation service computing device 160 illustrated in FIG. 1.

Using this data as inputs, the monitoring module 110*h* may determine one or more of the outputs, such as status change alert signal(s), recommended remediation actions(s), which may include location of blockage data, water supply valve actuator device signal(s), remediation service signal(s), and/or estimated occupancy signal(s). Of course, in certain instances, the monitoring module 110*h* may not receive remediation action data, environmental data, a verification signal, and/or all subsections of user data. In these instances, the monitoring module 110*h* may receive only sensor data of a particular sensor (e.g., a vibration signal), and may detect a status change of the fluid flow device proximate to the sensor sending the signal. The monitoring module 110*h* may then generate an alert signal, as an output, indicating the status change.

In certain embodiments, the monitoring module 110*h* may be configured to determine a general recommended remediation action to be included in the generated alert signal if the monitoring module 110*h* does not retrieve and/or otherwise receive remediation action data. However, in some aspects, the monitoring module 110*h* may require one or more of the remediation action data, environmental data, verification signal(s), and/or subsections of the user data to generate one or more of the status change alert signal(s) and recommended remediation action(s), which may include location of blockage data, water supply valve actuator device signal(s), remediation service signal(s), and/or estimated occupancy signal(s).

As an example, the monitoring module 110*h* may receive a plurality of vibration signals and the module 110*h* may proceed to analyze the signals in order to generate corresponding outputs. The vibration signals may indicate a status change and the module 110*h* may utilize remediation data to determine a recommended remediation action. In other instances, the vibration signals may indicate a status change and the module 110*h* may utilize environmental data.

For example, flash rainfall in the user's locality may increase the current flow rate in gutters (i.e., a fluid flow device) from zero to a non-zero flow rate. This may cause the monitoring module 110*h* to detect a status change as the current flow rate and the prior flow rate are dissimilar. The monitoring module 110*h* may then utilize environmental data and/or remediation action data to analyze the status change, determine a recommended remediation action, and/or generate an alert signal indicating the status change and recommended remediation action. In this example, the external server 170 may include environmental data 170*d* which may include the rainfall rate in the user's locality. The monitoring module 110*h* may access the known rainfall rate via the network 190. In this example, the rainfall rate may be 2 inches per hour (IPH) and the current flow rate may be 0.1 gallons per minute (GPM). The monitoring module 110*h* may further have access to receive/retrieve data indicating the expected GPM per IPH, for example 0.1 GPM per IPH, for the user's property size.

Thus, despite the current flow rate (0.1 GPM) exceeding the prior flow rate (0 GPM), as expected, the current flow rate (0.1 GPM) is still not as high as the determined/estimated current flow rate (0.2 GPM) based upon the rainfall rate (2 IPH). The status change then may be indicative of a potentially hazardous and/or otherwise problematic condition (e.g., an object is blocking water from entering the gutter and being transported a safe/requisite distance away from the structure), and the determined recommended remediation action may be for the user to safely observe the gutters for obstructions. In some embodiments, the monitoring module 110*h* may estimate the location of the blockage and include the location in the remediation action.

In certain embodiments, the monitoring module 110*h* may not generate an alert signal or not include a remediation action in the alert signal due to the status change being unnoteworthy as determined by the module 110*h* and/or user's preferences. Continuing the prior example, the monitoring module 110*h* may determine and/or the user may indicate a preference that the alert signal not be generated, or for the alert signal to not include any information, because the increased current flow rate is expected during rainfall. For example, the current flow rate may be 0.1 gallon per minute (GPM), the determined/estimated current flow rate per inch per hour (IPH) of rain for the user's property size may be 0.1 GPM, and the rainfall rate, as stored environmental data 170*d* on the external server 170, may be 1 IPH. Thus, the current flow rate of 0.1 GPH is expected during rainfall of 1 IPH, and a user may indicate not to be notified when the gutter is functioning as expected.

Additionally, or alternatively, the monitoring module 110*h* may determine and/or the user may indicate a preference that the alert signal should include information that is not intended to return the current flow rate to the prior flow rate. For example, in the prior example, the monitoring module 110*h* may generate an alert signal indicating that "A status change is detected, expect heavy rain for the coming hour" and/or "Gutters are functioning within expected parameters," because both flow rates are indicative of proper function of the fluid flow device. Accordingly, a detected change of fluid flow rate of any fluid flow device, which may cause the central server 110 to detect a status change, may be within an expected function of the fluid flow device, and as a result, may not necessitate a status change alert signal or a status change alert signal with a remediation action.

In some embodiments, the monitoring module 110*h* may receive/retrieve a verification signal. For example, a user may have received an alert signal indicating a status change. In certain instances, the user may have the option to positively and/or negatively verify a status change has occurred by observing the status change in person (or by proxy) and confirming the status change is present (i.e., positive verification) or not present (i.e., negative verification). If the user positively verifies the status change, the monitoring module 110*h* may receive/retrieve a verification signal. Such an exemplary feedback process may allow the system 100 to frequently adjust/optimize operation, such as by re-training a ML model (e.g., a model included as part of the monitoring module 110*h*) based upon the verification signal.

In certain embodiments, the monitoring module 110*h*, having received/retrieved the verification signal, may further generate, by the one or more processors 110*a*, recommended information for a remediation service; and/or initiate, by the one or more processors 110*a*, contact between a user computing device 120 and a remediation service computing device 160. For example, a user prompted by an alert signal to check their basement, may observe a broken pipe flooding the basement at a rapid rate and positively verify the status change. The monitoring module 110*h* may determine the user's need for a remediation service provider and generate the recommended information for a 24/7 emergency plumbing service. The monitoring module 110*h* may further initiate contact with the user and the plumber by initiating contact between their respective devices (e.g., user computing device 120, remediation service computing device 160).

As such, the monitoring module 110*h* may generate these outputs as and/or as part of a remediation service signal. In some embodiments, the remediation service signal may include any information to be sent to a remediation service and/or remediation service computing device (e.g., remediation service computing device 160), such as the user's property location, the status change alert signal, and/or information therein, and/or the urgency of the hazardous and/or otherwise problematic condition, among other possible information.

In some embodiments, the monitoring module 110*h* may determine that the status change is representative of an emergency condition and cause, by the one or more processors 110*a*, a water supply valve to close. In these embodiments, the fluid flow device by which the status change was determined is disposed within a structure having a water supply valve. Continuing the previous example, the monitoring module 110*h* may determine a broken pipe flooding a basement to be indicative of an emergency. If the user's property has a water supply valve and the valve is equipped with an actuator device (e.g., water supply valve actuator device 150), the monitoring module 110*h* may cause the water supply valve to close, thereby preventing further damage until the broken pipe can be remedied.

As previously mentioned, the monitoring module 110*h* may detect a status change based upon a comparison between the current flow rate and the prior flow rate. In some embodiments, the detection of a status change may further include the monitoring module 110*h* determining, by the one or more processors 110*a*, a difference value by subtracting the current flow rate from the prior flow rate. The monitoring module 110*h* may then compare an absolute value of the difference value to a flow rate threshold corresponding to the fluid flow device, and detect the status change of the fluid flow device based upon the absolute value of the difference value exceeding/not exceeding the flow rate threshold.

For example, the current flow rate of fluid in a fluid flow device may be 4 gallons per minute (GPM) while the prior flow rate may be 2 GPM. The absolute value of the difference of the prior flow rate and the current flow rate is equal to 2 GPM, represented formulaically as $|2\text{ GPM}-4\text{ GPM}|=2$ GPM. The monitoring module 110*h* may then compare this value to a threshold. In this instance, a change in flow rate of 3 GPM may be defined as the threshold value in the monitoring module 110*h*. The monitoring module 110*h* may then compare the difference value, 2 GPM, to the threshold value, 3 GPM, and may detect a status change. In this example, as 2 GPM does not exceed 3 GPM, the monitoring module 110*h* may not detect a status change. Additionally, the monitoring module 110*h* may be configured to receive/retrieve the flow rate threshold from sensor data 110*e*, for example, as the threshold value may be specific to fluid flow devices and/or their proximate sensors, and/or the threshold values may be inherently configured in the module 110*h*.

In some embodiments, the sensor may be or include a vibrational sensor and a sound sensor disposed proximate to the fluid flow device. Further in these embodiments, the monitoring module 110*h* may receive/retrieve a sound signal; and determine, by the one or more processors 110*a*, a second current flow rate within the fluid flow device based upon the sound signal. The monitoring module 110*h* may then detect, by the one or more processors 110*a*, the status change of the fluid flow device based upon a second comparison between the current flow rate, the second current flow rate, and the prior flow rate.

Still further in these embodiments, the sensors may be of any suitable organization (i.e., ordering), and may not be limited to vibration and/or sound sensors. In some embodiments, the second comparison may include the monitoring module 110*h* comparing, by the one or more processors 110*a*, a first absolute value of the difference value of the current flow rate (derived from the vibration signal) to a flow rate threshold corresponding to the fluid flow device. The monitoring module 110*h* may further compare a second absolute value of the difference value of the second current flow rate (derived from the sound signal) to a flow rate threshold corresponding to the fluid flow device. The monitoring module 110*h* may then detect, by one or more processors 110*a*, the status change of the fluid flow device based upon the first absolute value of the difference value of the current flow rate exceeding/not exceeding the flow rate threshold and the second absolute value absolute of the difference value of the second current flow rate exceeding/not exceeding the flow rate threshold.

For example, the first absolute value of the difference value of the current flow rate (derived from the vibration signal) may be 4 GPM, the acceptable change in flow rate (i.e., threshold) may be 3 GPM, and the second absolute value of the difference value of the current flow rate (derived from the sound signal) may be 2 GPM. The monitoring module 110*h* then may or may not detect a status change based upon the first difference value (4 GPM) exceeding the threshold (3 GPM) and the second difference value (2 GPM) not exceeding the threshold (3 GPM).

In certain embodiments, the fluid flow device may be or include (i) a sink and/or (ii) a toilet disposed within a structure. In these embodiments, the monitoring module 110*h* may further aggregate, by the one or more processors 110*a*, vibration signals corresponding to the fluid flow device during a time period. The monitoring module 110*h* may then determine, by the one or more processors, an estimated occupancy of the structure based upon the vibration signals aggregated during the time period.

For example, a property owner renting their home for a weekend may desire to know if the renters are abiding by maximum occupancy requirements. In this example, the monitoring module 110*h* may receive/retrieve sensor signals from sensor data 110*e* which correspond to a specific fluid flow device and aggregate the data. The module 110*h* may then receive/retrieve, and/or be inherently configured with, additional external data to determine the estimated occupancy of a structure. As previously discussed, the external data may include, but not limited to, the number of toilet apparatuses in the structure, the average number of times a day a human uses a toilet, the average number of times a human uses a sink after using a toilet, etc. Regardless, the monitoring module 110*h* may be configured to estimate the occupancy based upon data received/retrieved during the first 24 hours of the renter's occupancy, for example, and may notify the property owner with an estimated occupancy.

As previously discussed, in some embodiments, the monitoring module 110*h* may generally train one or more models (e.g., ML models) to output current flow rate(s), status change alert signal(s), recommended remediation action(s), location of blockage data, water supply valve actuator device signal(s), remediation service signal(s), and the estimated occupancy of a structure. In particular, the training dataset may include a plurality of training user data, (ii) a plurality of training sensor data, (iii) a plurality of training environmental data, (iv) a plurality of training verification signal data, (v) a plurality of training recommended remediation data, (vi) a plurality of training location blockage data, (vii) a plurality of training water supply valve actuator device data, (viii) a plurality of training remediation service provider data, (ix) a plurality of training estimated occupancy data, and/or other suitable combinations thereof. Of course, in certain embodiments, the monitoring module 110*h* may include a rules-based algorithm configured to receive the previously noted data as input (as illustrated in FIG. 2) and to output the previously noted outputs (as illustrated in FIG. 2).

Exemplary Implementation of a Computing System with a Structure

Figure 3:
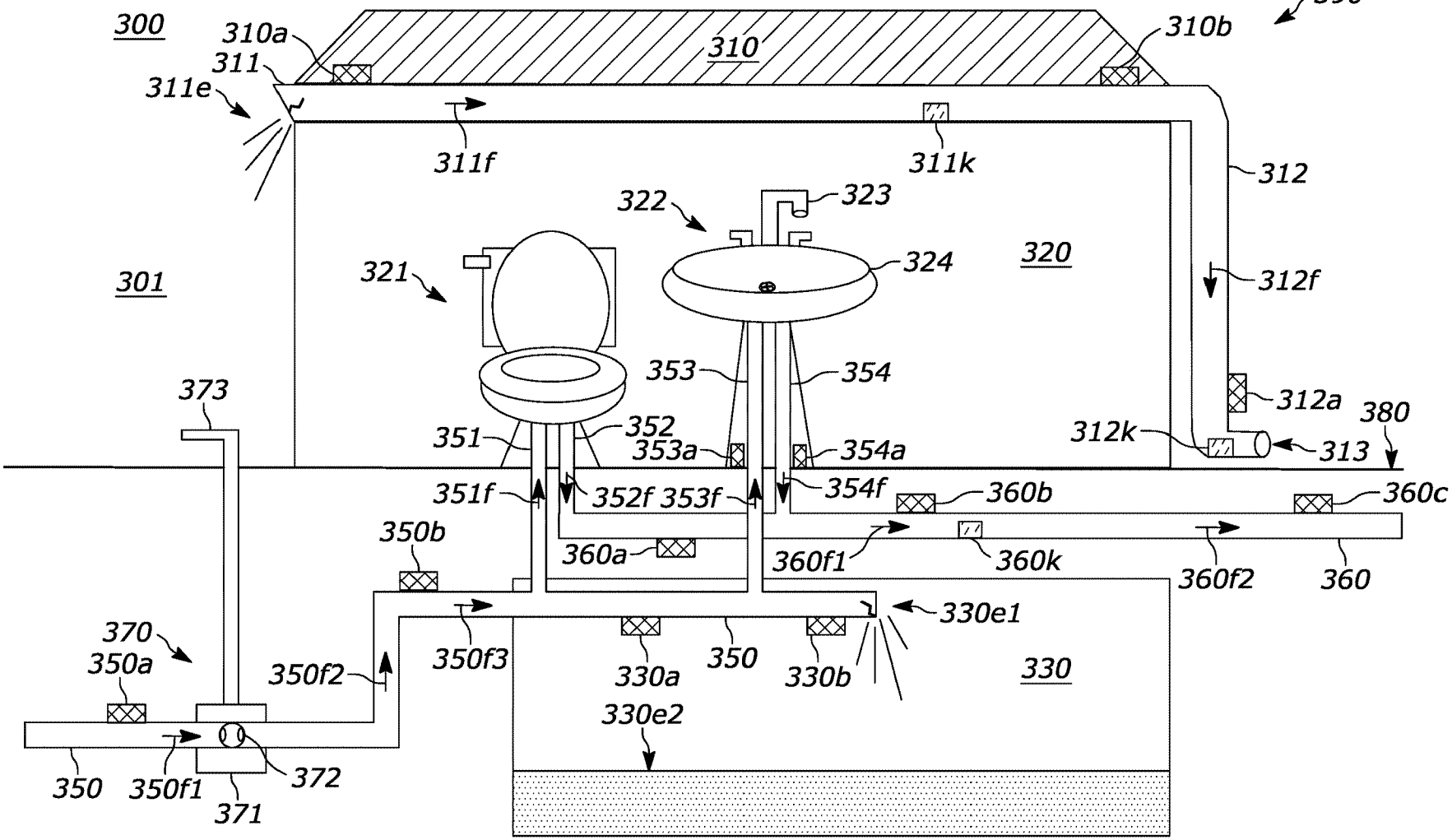
FIG. 3 illustrates an exemplary implementation of a computing system of FIG. 1 with a structure, in accordance with various embodiments described herein.

FIG. 3 illustrates the implementation 300 of an exemplary computing system to monitor and detect status changes to fluid flow devices with a structure, in accordance with various embodiments described herein. In general, FIG. 3 illustrates multiple scenarios in which monitoring fluid flow devices may prove useful (e.g., cracked gutter, clogged gutter/pipe, burst pipe, flooding basement). In particular, FIG. 3 illustrates how sensors proximate to the fluid flow devices allow for detecting status changes of the fluid flow devices and mitigation/remediation of the status changes as needed.

For example, a structure 390, with any number of fluid flow devices (e.g., a water supply pipe 350, a wastewater pipe 360, a gutter 311, a gutter pipe 312, or any combination thereof) has fluid flow devices that may function properly or improperly. As a result, these fluid flow devices may require monitoring, such that a user may know when maintenance/remediation may be required for any particular fluid flow device. As illustrated in FIG. 3, the structure 390 uses a horizontal gutter 311 affixed under and traversing the lowest point of the roof 310 to transport rainwater from the roof 310 and away from the structure 390. This prevents weathering of the structure, erosion of the ground 380 directly below the edge of the roof 310, and provides efficient movement of water away from the structure, among other benefits. As a result, any condition that prevents and/or otherwise diminishes this water transport may result in damages to the structure or other corresponding components/devices.

These conditions may be or include a broken gutter 311*e*, water flowing down the left side 301 of the structure 390, a buildup of leaves 311*k* preventing waterflow 311*f* (illustrated as an arrow) through the gutter 311, and/or other conditions or combinations thereof. The descending gutter pipe 312 may also be susceptible to a blockage 312*k* which may prevent water from flowing through the gutter pipe opening 313 to an appropriate distance away from the structure (e.g., 10-15 feet). The flow of water through the gutter pipe 312 is illustrated as an arrow 312*f*.

As illustrated in FIG. 3, a sensor (e.g., sensors 310*a*, 310*b*, 312*a*) disposed proximate to a gutter 311 or to a gutter pipe 312 may be able to continually record and send ambient vibration and/or sound data to the central server 110 via a signal, thereby monitoring the fluid flow devices. In certain embodiments, the central server 110 may receive and process the vibration signal to detect a status change of the gutter pipe 312, determine a recommended remediation action, and generate an alert signal indicating the status change and the remediation action. Upon receipt of the alert signal, the user may view the alert signal on the user computing device (e.g., user computing device 120), may inspect the gutter pipe 312 for a blockage 312*k*, and may remove the blockage 312*k* to adjust the current flow rate of the gutter pipe 312 to the prior flow rate.

In certain embodiments, the recommended remediation action may include the location of the blockage 312*k* in the gutter pipe 312. As an example, the blockage 312*k* may be near the gutter pipe opening 313. The gutter pipe sensor 312*a* may be proximate to the gutter pipe opening 313 and the blockage 312*k*, while the rightmost roof sensor 310*b* may be less proximate to the gutter pipe opening 313 and the blockage 312*k*. In this example, the gutter pipe sensor 312*a* is more proximate to the blockage 312*k* than the rightmost roof sensor 310*b*; however, both sensor's signals may be used to detect a status change and/or determine the blockage 312*k* may be closer to the sensor to which it is most proximate (e.g., gutter pipe sensor 312*a*). It should be understood that any sensor may be used to determine a current flow rate for the fluid flow devices they are proximate to, and the sensor's location relative to other sensors may also be used concurrently for any configured purpose (e.g., to detect a status change, determine a remediation action, and/or extrapolate any possible condition of which the sensor's signal is understood to be determinant).

As another example, in the interior 320 of the structure 390, a toilet apparatus 321 and a sink apparatus 322 may occupy the structure interior 320 to service the occupants of the structure 390. Both apparatuses 321, 322 may utilize pipes (e.g., 351, 353) to supply water and pipes (e.g., 352, 354) to transport wastewater away from the structure 390. The direction of fluid flow within the pipes 351,352, 353, 354 is illustrated by arrows 351*f*, 352*f*, 353*f*, 354*f*. Sensors (e.g., 350*b*, 353*a*, 354*a*, 360*a*, 360*b*) proximate to the pipes (e.g., 351, 352, 353, 354) may be able to monitor the use of the apparatuses 321, 322, and enable potentially hazardous and/or otherwise problematic conditions to be assessed. For example, an occupant may accidentally leave a faucet 323 of a sink 322 running, such that water eventually overflows the sink bowl 324 and spills over to the floor 380, causing water damage. Another example may include a faucet 323 that continuously leaks, and small drips may slowly contribute to a significant loss of resources (e.g., money, natural resources, etc.). However, if the faucet 323 is properly monitored, the system 100 (e.g., the central server 110) may determine/detect a sound of a consistent water drip that requires remediation.

In yet another example, the sink 322 water supply pipe sensor 353*a* may be a vibration sensor capable of sending a vibration signal to the central server 110, and the sink 322 wastewater pipe sensor 354*a* may be a sound sensor capable of sending a sound signal to the central server 110. A user may leave the faucet 323 running, and the sink 322 may drain water more slowly than water is flowing into the sink 322. The central server 110 may then detect a status change based upon a second comparison between the current flow rate as derived from the vibration signal, a second current flow rate as derived from the sound signal, and a prior flow rate.

Of course, the central server 110 may not only be able to detect a status change by comparing flow rates, but may also anticipate the potentially hazardous and/or otherwise problematic condition of an overflowing sink 322 because the flow rate of the water supply pipe 353 is greater than the flow rate of the wastewater pipe 354. Consequently, if the flow rates of the water supply pipe 353 and the wastewater pipe 354 remain constant, the sink 322 may overflow and cause damage to the floor 380 or other portions of the structure 390.

Further, it should be understood that any stepwise organization of sensors may be appropriate to perform the monitoring of the fluid flow devices (e.g., a vibration sensor may be replaced by a sound sensor and vice versa) described herein. For example, placing a sound sensor (e.g., 354*a*) on a wastewater pipe (e.g., 354) or generally proximate to an apparatus (e.g., 321, 322) to sense sound may be more advantageous than placing a vibration sensor (e.g., 353*a*) in the same location. The sound sensor 354*a* may thereby sense sounds corresponding to the dripping of a faucet 323, and/or other sounds that the vibration sensor 353*a* may be unable to detect.

In some embodiments, the monitoring of fluid flow devices (e.g., a toilet apparatus 321 or sink apparatus 322) may enable the central server 110 to determine an estimated occupancy of the structure 390. As an example, the wastewater pipe sensor 360*a* may be proximate to the toilet apparatus 321 and a corresponding wastewater pipe 352 of the toilet 321. Throughout a time period (e.g., 24 hours) the sensor 360*a* (e.g., vibration sensor) may send a plurality of signals (e.g., vibration signals) to the central server 110. The central server 110 may then aggregate all the vibration signals, for example, corresponding to a fluid flow device during this time period and determine an estimated occupancy of the structure. Additionally, the central server 110 may utilize external data to determine the estimation, including, but not limited to, the number of toilet apparatuses (e.g., toilet apparatus 321) in the structure, the average number of times a day a human uses a toilet, the average number of times a human uses a sink after using a toilet, etc.

The foundation 340 of the structure 390 may include and/or otherwise receive/accommodate pipes 350, 360 which may supply the structure 390 with water (flow of water illustrated by arrows 350*f*1-3) or carry wastewater away from the structure 390. As illustrated in FIG. 3, the sensors 350*a-b*, 330*a-b*, 360*a-c* may be placed proximate to the fluid flow devices (i.e., pipes) to allow for monitoring. In some embodiments, when a status change has been detected, the recommended remediation action may include one of (i) patching a portion of the fluid flow device, (ii) unblocking a portion of the fluid flow device (such as either manually or in an automated fashion, such as via autonomous or remotely controlled crawlers or other robots that are insertable into the fluid flow device), or (iii) adjusting a configuration of the fluid flow device.

As an example, sensor 360*b* may be proximate to a pipe blockage 360*k* while sensor 360*c* may be less proximate to the blockage 360*k*. Furthermore, the fluid flow preceding the blockage 360*k* may be greater, as illustrated by the bold arrow 360*f*1, than the fluid flow following the blockage 360*k*, as illustrated by the narrow arrow 360*f*2. The central server 110 may receive data from the sensors 360*b*, 360*c* indicating the difference in fluid flow, and may detect the status change and determine a recommended remediation action that may include unblocking a portion of the fluid flow device. In certain embodiments, the recommended remediation action may also include the location of the blockage (e.g., following sensor 360*b*, preceding sensor 360*c*).

The water supply pipe 350 may continue from its source on the left side 301 of the structure 390 into an exemplary basement 330, where two sensors 330*a* and 330*b* are proximate to the water supply pipe 350. In particular, the water supply pipe 350 may be flooding the basement 330 with water 330*e*2 due to a malfunction 330*e*1 (e.g., cracked pipe, improperly sealed pipe end, etc.). The water 330*e*2 in the basement 330, and in general under the ground 380 and/or near the foundation 340, may have the potential for significant damage to the structure 390, such that proper, immediate remediation may be required.

In this example illustrated in FIG. 3, the central server 110 may determine a detected status change to be representative of an emergency condition (e.g., flooding in the basement 330). The central server 110 may then send an alert signal indicating the emergency to computing devices (e.g., user computing device 120, remediation service computing device 160), call computing device(s) with telecommunication capabilities (e.g., a user's cell phone, which may also be the user computing device 120), and/or in embodiments where the fluid flow device is disposed within a structure 390 that has a water supply valve 370, cause a water supply valve 370 to close.

More particularly, a water supply valve 370 may include a hollow ball 372 that prevents water flow when turned 180 degrees, and/or a manual method of closing the water supply valve 370 via a handle 373 accessible to structure 390 occupants. The hollow ball 372 is exemplary and does not limit the use of other forms of valves. To achieve closure of the water supply valve 370 described in aforementioned embodiments, a water supply valve actuator device 371 may be included as a part of the water supply valve 370. The actuator device may also be above ground 380 proximate to the manual water supply valve handle 373 and/or any location which allows for the implementation of the embodiments to remotely close the water supply valve 370.

In certain embodiments, the central server 110 may prevent a potentially hazardous and/or otherwise problematic/emergency condition by utilizing environmental data representative of an external environmental condition. For example, as temperatures drop below freezing, the central server 110 may receive/retrieve temperature data and begin processing sensor signals which may indicate ice crystals forming in the fluid flow devices. Such ice crystals may form and collect until the fluid flow devices burst, and may be unavoidable regardless of preventative measures (e.g., insulating pipes, heating pipes, etc.); however, turning off the water supply to the structure 390 may avoid ice crystal formation. Accordingly, in some embodiments, the central server 110 may be configured to cause the water supply valve 370 to close as a preventative measure, as well as causing the water supply valve 370 to close as a remediation measure. Furthermore, the central server 110 may do this with or without receiving/retrieving supplemental data (e.g., environmental data).

Exemplary Graphical User Interface (GUI) of a User Computing Device to Detect Status Changes to Fluid Flow Devices FIG. 4 depicts a graphical user interface (GUI) 400 used to display, for example, user data, remediation action data, and/or alerts to changes in fluid flow status, in accordance with various embodiments described herein. Generally, the GUI 400 allows the user to interact with the system 100 and thus the central server 110, which may include receiving outputs from the central server 110 or sending inputs to the central server 110 as aggregated in the exemplary workflow of FIG. 2. The GUI 400 thus provides the user with a designated place to be informed on the functioning of a computing system (e.g., exemplary computing system 100) depicted in FIG. 1 and the implementation 300 of a computing system depicted in FIG. 3.

The GUI 400 generally includes features configured to enable a user (e.g., a homeowner, property manager, current occupant, etc.) to interact with the central server 110. Namely, the GUI 400 may include (i) a user data hub 410 where sensor data 110*e* and/or user profile data 110*f* is displayed (ii) a remediation action hub 440 where remediation data 110*g* is displayed (iii) an alert signal hub 450 where sensor data 110*e* may also be displayed.

As illustrated in FIG. 4 in the user data hub 410, sensor data 110*e* may be displayed in a sensor data hub 420 to provide the user with a list of sensor(s) operating within the computing system 100 and specific information on each sensor. This information, as illustrated, may include the identification number 421*a*, 422*a* of the sensor, whether the sensor is online 421*b* or offline 422*b*, or a functionality to play the vibration signal 421*c*, 421*d* or sound signal 422*c*, 422*d* for the user to hear. Accordingly, a vibration sensor hub 421 may include a plurality of vibration sensor information (e.g., 421*a*, 421*b*, 421*c*) and/or a sound sensor hub 422 may include a plurality of sound sensor information (e.g., 422*a*, 422*b*, 422*c*) that is received at the central server 110 and/or otherwise aggregated by the exemplary computing system 100. As illustrated in FIG. 4, in the user data hub 410, user profile data 110*f* may also be displayed in the user profile hub 430 to provide the user with information specific to their profile. This information may include their account identification number 431 and/or the user-specific remediation service provider contact information 433.

In certain embodiments, the computing system 100 may further determine an estimated occupancy of the structure, and this estimated occupancy may be included with user profile data 110*f* for display in the user profile hub 430. For illustrative purposes, the dashed-line box surrounding the estimated occupancy display 432 is used to denote this embodiment. Furthermore, it should be understood that any user data, user profile data, and/or sensor data may be displayed generally in the GUI 400 or specifically in the user data hub 410.

FIG. 4 further illustrates how remediation data 110*g* may be displayed in a remediation action hub 440 to provide the user with the recommended remediation action 441 determined by the computing system 100. The text displayed as the recommended remediation action 441 is an exemplary recommended remediation action of an exemplary emergency condition. In some embodiments, the central server 110 may further determine an estimated location of a blockage and include the estimated location in the remediation action. As a result, this estimated location may be displayed in the remediation action hub 440. Furthermore, it should be understood that any remediation data may be displayed generally in the GUI 400 or specifically in the remediation data hub 440.

As illustrated in FIG. 4, information from the status change alert signal output illustrated in FIG. 2 may be displayed in an alert signal hub 450 to provide the user with information regarding a status change detected by the computing system 100. This may include a status change display 451 and whether a status change has been detected display 451*a*, with the text therein being exemplary. In certain embodiments, the central server 110 may further determine a status change of a fluid flow device is representative of an emergency condition (e.g., flooding, broken pipe, frozen pipe). As a result, this emergency condition status may be included with a status change alert signal output and may be displayed in the alert signal hub 450. For illustrative purposes, the dashed-line boxes surrounding the emergency condition determined display 452 and the status of an emergency condition display 452*a* are used to denote this embodiment.

In some embodiments, the central server 110 may receive a verification signal to confirm whether an emergency condition is present (e.g., a user witnessing a flooding basement 330*e*2, a broken pipe 330*e*1). The GUI 400 may functionally support the embodiments by including a prompt 453 for the presence of an emergency condition and an interactive display 453*a*, 453*b* used by the user to answer the prompt 453. The user may answer the prompt 453 to positively verify the presence of an emergency condition by pressing YES 453*a* or negatively verify that no emergency condition is present by pressing NO 453*b*. For illustrative purposes, the dashed-line boxes surrounding the prompt 453, YES 453*a*, and NO 453*b*, are used to denote this embodiment. Furthermore, it should be understood that any alert signal data may be displayed generally in the GUI 400 or specifically in the alert signal hub 450.

Exemplary Methods to Detect Status Changes to Fluid Flow Devices

Figure 5:
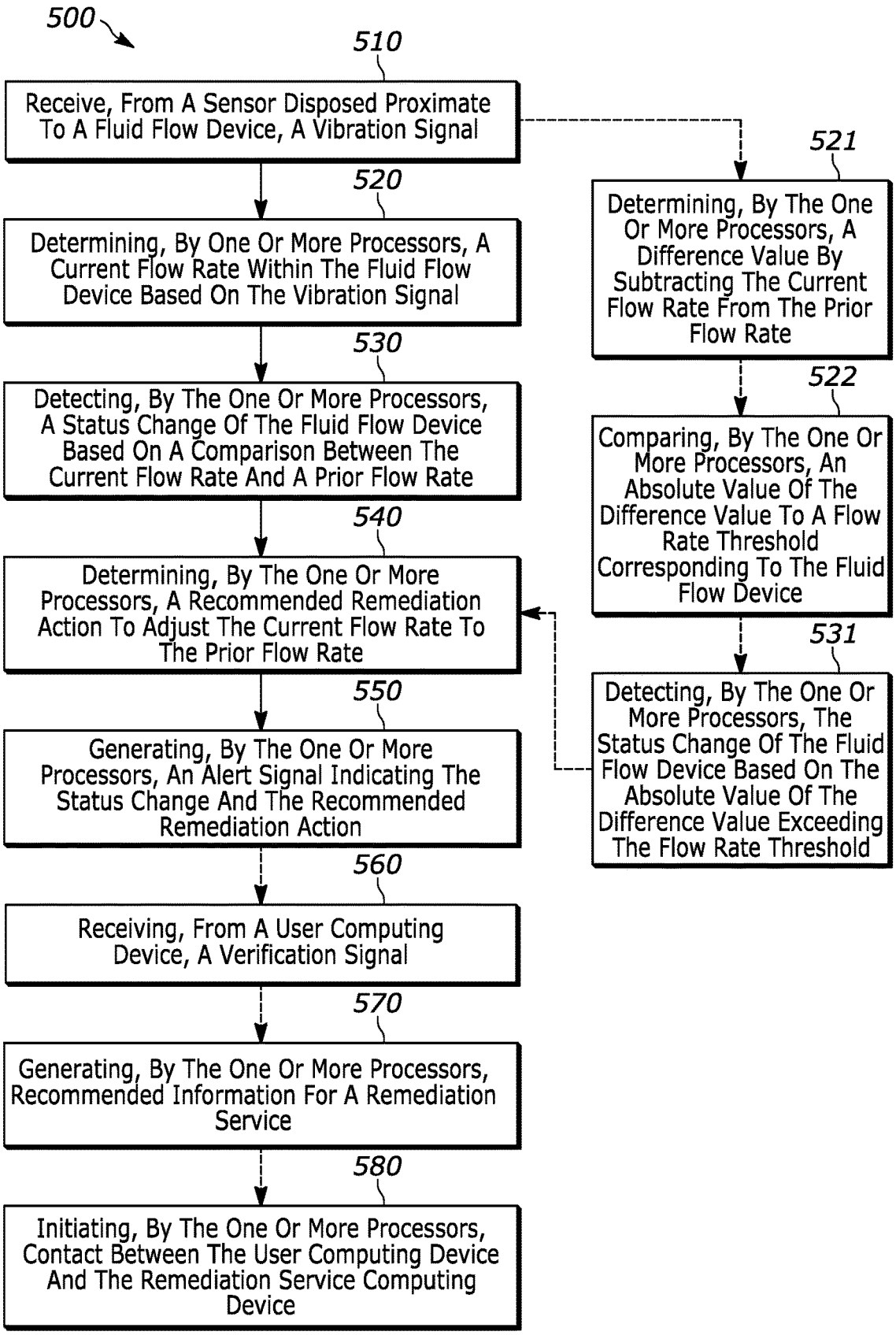
FIG. 5 depicts a flow diagram representing an exemplary computer-implemented method for detecting status changes to fluid flow devices, in accordance with various embodiments described herein.

FIG. 5 depicts a flow diagram representing an exemplary computer-implemented method 500 for detecting status changes to fluid flow devices, in accordance with various embodiments described herein. The method 500 may be implemented a computing system 100 such as the central server 110, the user computing device 120, and/or an external server 170.

The method 500 includes receiving, from a sensor disposed proximate to a fluid flow device, a vibration signal (block 510). For example, as fluid flows through a device, it causes vibrations; and various flow rates may correspond to various corresponding vibrations. When a sensor is proximate to a fluid flow device it may detect the ambient vibrations caused by the flow of fluid, which the sensor may interpret into a vibration/sound signal. Furthermore, this vibration signal may include, for example, (i) a source of the vibration signal (e.g., sensor identification number, sensor location, user identification number); (ii) vibration data (e.g., analog or digital representation of sinusoidal waveform(s)); and/or (iii) time-stamp data correlating to the time the signal was recorded and/or sent to the central server 110. The vibration signal may generally indicate how the included information should be processed.

The method 500 further includes determining a current flow rate within the fluid flow device based upon the vibration signal (block 520). For example, utilizing the information within a signal, processors may determine how quickly fluid is flowing through a fluid flow device. In certain embodiments, wherein the fluid flow device is (i) a sink, or (ii) a toilet disposed within a structure, the method 500 may further include aggregating, by the one or more processors, sensor signals (e.g., vibration signals) corresponding to the fluid flow device during a time period. In these embodiments, the method 500 may further include determining an estimated occupancy of the structure based upon the sensor signals aggregated during the time period.

In these embodiments, the estimation may include external data, including, but not limited to, the number of toilet apparatuses in the structure, the average number of times a day a human uses a toilet, the average number of times a human uses a sink after using a toilet, etc. Further in these embodiments, the estimation may be determined by a monitoring module 110*h*, as illustrated in FIGS. 1 and 2. In certain embodiments, the aggregation of sensor signals may lead to other determinations, all of which may be displayed for the user. Generally, the estimated occupancy may be utilized by other aspects of a system, such as being displayed on a user computing device 120.

The method 500 further includes detecting a status change of the fluid flow device based upon a comparison between the current flow rate and a prior flow rate (block 530). For example, when the flow rate through a fluid flow device is not consistent, the flow rate at one moment in time may be different than at the next moment in time. This change in flow rate may be detected as a status change. Flow rate may rarely be consistent and exactly the same. Accordingly, in certain aspects, a threshold may be established for the comparison of current flow rate and prior flow rate to be compared to, to determine whether a status change is warranted.

In certain aspects, wherein the fluid flow device is disposed within a structure having a water supply valve, the method 500 may further include determining that the status change is representative of an emergency condition; and causing the water supply valve to close. In these aspects, the actualization of the water supply valve closure may be accomplished by various means, some embodiments of which are exemplified in FIG. 3 illustrating a water supply valve actuator device 370. Further in these aspects, an emergency condition may include an unwanted condition as determined by a system, which may or may not be an emergency.

In certain aspects, the method 500 may further include receiving/retrieving external environmental data representative of an environmental condition; and determining the status change of the fluid flow device based upon a second comparison between the current flow rate, the external environment data, and the prior flow rate. In these embodiments, the external environmental data may be sourced from an external server, as exemplified in FIG. 1, or by other means (e.g., manual input by user, direct input from a workstation, etc.). Furthermore, in some embodiments, the external environmental data may be utilized in other processes including, but not limited to, causing a water supply valve to close/open, determining flow rate comparisons are within/without a tolerable threshold, determining whether to generate an alert signal, or any combination therein.

In certain embodiments, the sensor may be a vibrational sensor disposed proximate to the fluid flow device. In these embodiments, the method 500 may further include receiving/retrieving, from a sound sensor, a sound signal; determining a second current flow rate within the fluid flow device based upon the sound signal; and/or detecting the status change of the fluid flow device based upon a second comparison between the current flow rate, the second current flow rate, and the prior flow rate. In these embodiments, the sensors may be of any suitable organization (i.e., ordering), and may not be limited to vibration or sound sensors. In some embodiments, the second comparison may include comparing a first absolute value of the difference value of the current flow rate (derived from the vibration signal) to a flow rate threshold corresponding to the fluid flow device, and a second absolute value of the difference value of the second current flow rate (derived from the sound signal) to a flow rate threshold corresponding to the fluid flow device. Further in these embodiments, the method 500 may include detecting the status change of the fluid flow device based upon the first absolute value of the difference value of the current flow rate exceeding the flow rate threshold and the second absolute value absolute of the difference value of the second current flow rate exceeding the flow rate threshold. In some embodiments, the second comparison may generally include the necessary rules-based considerations for the computer-implemented method to determine a status change.

The method 500 further may include determining a recommended remediation action to adjust the current flow rate to the prior flow rate (block 540). For example, a prolonged fluid flow may be indicative of a shower left running or a pipe burst in a basement of a structure. Utilizing contextual information, the remediation action may be or include checking the shower and/or to check the basement, and to turn off the shower and/or turn off the water supply to the structure until the burst pipe can be remedied. In both instances the current flow rate may be adjusted to its prior flow rate.

In certain embodiments, the fluid flow device may be a gutter disposed on a structure exterior. In these embodiments, the method 500 may further include determining that the gutter is unable to distribute water a threshold distance away from the structure exterior; determining an estimated location of a blockage of the gutter based upon the sensor signal; and/or including the estimated location of the blockage in the recommended remediation action. Further in these embodiments, the threshold distance water should be distributed away from the gutter may be determined by a system and/or component (e.g., central server 110), and/or be sourced (i.e., received/retrieved) from an external server, or by other means (e.g., manual input by user, direct input from a workstation, etc.).

Moreover, in some embodiments, the method 500 may include determining that a fluid flow device, in general, is unable to distribute/pass water; determining an estimated location of a blockage of the fluid flow device based upon the sensor signal; and/or further including the estimated location of the blockage in the recommended remediation action. In these embodiments, the fluid flow device may include, without limitation, a gutter (as described in previous aspects), a pipe, a drain, and/or any other suitable devices or combinations thereof. Furthermore, in some embodiments, the recommended remediation action of the method 500 may include at least one of (i) patching a portion of the fluid flow device, (ii) unblocking a portion of the fluid flow device, or (iii) adjusting a configuration of the fluid flow device.

The method 500 further includes generating an alert signal indicating the status change and the recommended remediation action (block 550). For example, the detection of a status change and the determination of a recommended remediation action may not be utilized by the user until the information becomes translated into the alert signal and displayed via the user computing device 120. This alert signal thereby notifies the user, and enables the user to monitor and/or initiate remediation of the fluid flow devices.

In some embodiments, the recommended remediation action may include whether an emergency condition has been determined. In this embodiment, the method 500 further includes receiving, from a user computing device, a verification signal (block 560). As described in previous examples, a user may positively or negatively verify the status change, as indicated by an alert signal, and cause a verification signal to be sent. In these embodiments, the method 500 further includes generating recommended information for a remediation service (block 570). The recommended information for a remediation service may include, for example, contact information, hours of operation, available service providers within the user's locality, etc. Further in this embodiment, the method 500 may include initiating contact between the user computing device and the remediation service computing device (block 580). When, for example, a user is experiencing an emergency (e.g., burst pipe in their basement), it may be advantageous to provide immediate consult from a remediation service on how to proceed and minimize the potential damage.

In some embodiments, the detection of a status change may include additional steps/actions. In these embodiments, the method 500 may include receiving, from a sensor disposed proximate to a fluid flow device, a vibration signal (block 510). The method 500 may further include determining a difference value by subtracting the current flow rate from the prior flow rate (block 521) and comparing an absolute value of the difference value to a flow rate threshold corresponding to the fluid flow device (block 522). Further in these embodiments, the method 500 may include detecting the status change of the fluid flow device based upon the absolute value of the difference value exceeding the flow rate threshold (block 531). Thereafter, the method 500 may include determining the recommended remediation action to adjust the current flow rate to the prior flow rate (block 540), and/or generating the alert signal indicating the status change and the recommended remediation action (block 550).

Generally speaking, the method 500 may also utilize one or more machine learning (ML) techniques to train and/or utilize a plurality of models as ML model(s). A machine learning (ML) model may be configured to receive user data, environmental data, remediation action data, and/or verification signal data and output current flow rate(s), status change alert signal(s), recommended remediation action(s), location of blockage data, water supply valve actuator device signal(s), remediation service signal(s), and/or the estimated occupancy of a structure. In these aspects, the method may further include training, by one or more processors, the ML model using (i) a plurality of training user data, (ii) a plurality of training sensor data, (iii) a plurality of training environmental data, (iv) a plurality of training verification signal data, (v) a plurality of training recommended remediation data, (vi) a plurality of training location blockage data, (vii) a plurality of training water supply valve actuator device data, (viii) a plurality of training remediation service provider data, and/or (ix) a plurality of training estimated occupancy data. Accordingly, the method 500, when described herein as determining/detecting/generating outputs for endogenous and/or exogenous use, the method 500 may include applying, by the one or more processors, an ML model.

It will be understood that the above disclosure is one example and does not necessarily describe every possible embodiment. As such, it will be further understood that alternate embodiments may include fewer, alternate, and/or additional steps or elements.

Additional Considerations

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

The systems and methods described herein are directed to an improvement to computer functionality, and improve the functioning of conventional computers. Additionally, certain embodiments are described herein as including logic or a number of routines, subroutines, applications, or instructions. These may constitute either software (e.g., code embodied on a non-transitory, machine-readable medium) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired), or temporarily configured (e.g., programmed) to operate in a certain manner or to perform certain operations described herein. Considering embodiments in which hardware modules are temporarily configured (e.g., programmed), each of the hardware modules need not be configured or instantiated at any one instance in time. For example, where the hardware modules include a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses) that connect the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or routines described herein may be at least partially processor-implemented. For example, at least some of the operations of a method may be performed by one or more processors or processor-implemented hardware modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

It should also be understood that, unless a term is expressly defined in this patent using the sentence "As used herein, the term ' ' is hereby defined to mean . . . " or a similar sentence, there is no intent to limit the meaning of that term, either expressly or by implication, beyond its plain or ordinary meaning, and such term should not be interpreted to be limited in scope based upon any statement made in any section of this patent (other than the language of the claims). To the extent that any term recited in the claims at the end of this disclosure is referred to in this disclosure in a manner consistent with a single meaning, that is done for sake of clarity only so as to not confuse the reader, and it is not intended that such claim term be limited, by implication or otherwise, to that single meaning.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still cooperate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also may include the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

Upon reading this disclosure, those of skill in the art will appreciate still additional alternative structural and functional designs for evaluation properties, through the principles disclosed herein. Therefore, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. A computer-implemented method for detecting status changes to fluid flow devices, the method comprising:

receiving, from a sensor disposed proximate to a fluid flow device, a vibration signal;

determining, by one or more processors, a current flow rate within the fluid flow device based upon the vibration signal;

detecting, by the one or more processors, a status change of the fluid flow device based upon a comparison between the current flow rate and a prior flow rate;

determining, by the one or more processors, an estimated occupancy of a structure corresponding to the fluid flow device based at least in part upon the vibration signal;

determining, by the one or more processors, a recommended remediation action to adjust the current flow rate to the prior flow rate; and generating, by the one or more processors, an alert signal indicating the status change, the recommended remediation action, and the estimated occupancy.

2. The computer-implemented method of claim 1, wherein detecting the status change of the fluid flow device further comprises:

determining, by the one or more processors, a difference value by subtracting the current flow rate from the prior flow rate;

comparing, by the one or more processors, an absolute value of the difference value to a flow rate threshold corresponding to the fluid flow device; and detecting, by the one or more processors, the status change of the fluid flow device based upon the absolute value of the difference value exceeding the flow rate threshold.

3. The computer-implemented method of claim 1, wherein the fluid flow device is disposed within a structure having a water supply valve, and the method further comprises:

responsive to determining that the status change is representative of an emergency condition, causing, by the one or more processors, the water supply valve to close.

4. The computer-implemented method of claim 1, wherein the fluid flow device is a gutter disposed on a structure exterior, and the method further comprises:

determining, by the one or more processors, that the gutter is unable to distribute water a threshold distance away from the structure exterior; and determining, by the one or more processors, an estimated location of a blockage of the gutter based upon the vibration signal; and wherein the recommended remediation action includes the estimated location of the blockage.

5. The computer-implemented method of claim 1, further comprising:

receiving, at the one or more processors, external environment data representative of an external environmental condition; and determining, by the one or more processors, the status change of the fluid flow device based upon a second comparison between the current flow rate, the external environment data, and the prior flow rate.

6. The computer-implemented method of claim 1, wherein the sensor is a vibrational sensor disposed proximate to the fluid flow device, and the method further comprises:

receiving, from a sound sensor, a sound signal;

determining, by the one or more processors, a second current flow rate within the fluid flow device based upon the sound signal; and detecting, by the one or more processors, the status change of the fluid flow device based upon a second comparison between the current flow rate, the second current flow rate, and the prior flow rate.

7. The computer-implemented method of claim 1, wherein the fluid flow device is (i) a sink or (ii) a toilet disposed within a structure, and the method further comprises:

aggregating, by the one or more processors, vibration signals corresponding to the fluid flow device during a time period; and determining, by the one or more processors, an updated estimated occupancy of the structure based upon the vibration signals aggregated during the time period.

8. The computer-implemented method of claim 1, wherein the recommended remediation action includes at least one of (i) patching a portion of the fluid flow device, (ii) unblocking a portion of the fluid flow device, or (iii) adjusting a configuration of the fluid flow device.

9. The computer-implemented method of claim 1, further comprising:

receiving, from a user computing device, a verification signal;

generating, by the one or more processors, recommended information for a remediation service; and initiating, by the one or more processors, contact between the user computing device and a remediation service computing device.

10. A system for detecting status changes to fluid flow devices, comprising:

one or more processors; and a non-transitory computer-readable memory coupled to the one or more processors, the memory storing instructions thereon that, when executed by the one or more processors, cause the one or more processors to:

receive, from a sensor disposed proximate to a fluid flow device, a vibration signal, determine a current flow rate within the fluid flow device based upon the vibration signal, detect a status change of the fluid flow device based upon a comparison between the current flow rate and a prior flow rate, determine an estimated occupancy of a structure corresponding to the fluid flow device based at least in part upon the vibration signal, determine a recommended remediation action to adjust the current flow rate to the prior flow rate, and generate an alert signal indicating the status change, the recommended remediation action, and the estimated occupancy.

11. The system of claim 10, wherein the instructions, when executed, further cause the one or more processors to detect the status change of the fluid flow device by:

determining a difference value by subtracting the current flow rate from the prior flow rate;

comparing an absolute value of the difference value to a flow rate threshold corresponding to the fluid flow device; and detecting the status change of the fluid flow device based upon the absolute value of the difference value exceeding the flow rate threshold.

12. The system of claim 10, wherein the fluid flow device is disposed within a structure having a water supply valve, and the instructions, when executed, further cause the one or more processors to:

responsive to determining that the status change is representative of an emergency condition, cause the water supply valve to close.

13. The system of claim 10, wherein the fluid flow device is a gutter disposed on a structure exterior, and the instructions, when executed, further cause the one or more processors to:

determine that the gutter is unable to distribute water a threshold distance away from the structure exterior; and determine an estimated location of a blockage of the gutter based upon the vibration signal; and wherein the recommended remediation action includes the estimated location of the blockage.

14. The system of claim 10, wherein the instructions, when executed, further cause the one or more processors to:

receive external environment data representative of an external environmental condition; and determine the status change of the fluid flow device based upon a second comparison between the current flow rate, the external environment data, and the prior flow rate.

15. The system of claim 10, wherein the sensor is a vibration sensor disposed proximate to the fluid flow device, and the instructions, when executed, further cause the one or more processors to:

receive, from a sound sensor, a sound signal;

determine a second current flow rate within the fluid flow device based upon the sound signal; and detect the status change of the fluid flow device based upon a second comparison between the current flow rate, the second current flow rate, and the prior flow rate.

16. A tangible non-transitory machine-readable medium comprising instructions for detecting status changes to fluid flow devices that, when executed, cause a machine to at least:

receive, from a sensor disposed proximate to a fluid flow device, a vibration signal;

determine a current flow rate within the fluid flow device based upon the vibration signal;

detect a status change of the fluid flow device based upon a comparison between the current flow rate and a prior flow rate;

determine an estimated occupancy of a structure corresponding to the fluid flow device based at least in part upon the vibration signal, determine a recommended remediation action to adjust the current flow rate to the prior flow rate; and generate an alert signal indicating the status change, the recommended remediation action, and the estimated occupancy.

17. The tangible non-transitory machine-readable medium of claim 16, wherein the instructions, when executed, further cause the machine to at least detect the status change of the fluid flow device by:

determining a difference value by subtracting the current flow rate from the prior flow rate;

comparing an absolute value of the difference value to a flow rate threshold corresponding to the fluid flow device; and detecting the status change of the fluid flow device based upon the absolute value of the difference value exceeding the flow rate threshold.

18. The tangible non-transitory machine-readable medium of claim 16, wherein the fluid flow device is disposed within a structure having a water supply valve, and the instructions, when executed, further cause the machine to at least:

responsive to determining that the status change is representative of an emergency condition, cause the water supply valve to close.

19. The tangible non-transitory machine-readable medium of claim 16, wherein the fluid flow device is a gutter disposed on a structure exterior, and the instructions, when executed, further cause the machine to at least:

determine that the gutter is unable to distribute water a threshold distance away from the structure exterior; and determine an estimated location of a blockage of the gutter based upon the vibration signal; and wherein the recommended remediation action includes the estimated location of the blockage.

20. The tangible non-transitory machine-readable medium of claim 16, wherein the sensor is a vibration sensor disposed proximate to the fluid flow device, and the instructions, when executed, further cause the machine to at least:

receive, from a sound sensor, a sound signal;

determine a second current flow rate within the fluid flow device based upon the sound signal; and detect the status change of the fluid flow device based upon a second comparison between the current flow rate, the second current flow rate, and the prior flow rate.

* * * * *